US006202997B1

(12) United States Patent
Yasuda

(10) Patent No.: US 6,202,997 B1
(45) Date of Patent: Mar. 20, 2001

(54) WORK DEVICE AND ITS MOVEABLE CLAW

(75) Inventor: Yoshikazu Yasuda, Ishikawa (JP)

(73) Assignee: Yasuda Seisakusho Co., Ltd., Ishikawa (JP)

( * ) Notice: Subject to any disclaimer, the term of this patent is extended or adjusted under 35 U.S.C. 154(b) by 0 days.

(21) Appl. No.: 09/017,419

(22) Filed: Feb. 2, 1998

(51) Int. Cl.[7] ..... B25B 1/02

(52) U.S. Cl. ..... 269/212; 269/43; 269/89; 269/195; 269/208

(58) Field of Search ..... 269/212, 43, 55, 269/89, 139, 195, 208, 122, 138, 190, 217, 147

(56) References Cited

U.S. PATENT DOCUMENTS

| | | | | |
|---|---|---|---|---|
| 665,398 | * | 1/1901 | Braodbooks | 269/203 |
| 1,108,519 | * | 8/1914 | Reese | 269/217 |
| 1,221,897 | * | 4/1917 | Pall | 269/203 |
| 1,780,018 | * | 10/1930 | Kahle | 269/147 |
| 1,930,177 | * | 10/1933 | Miller et al. | 269/147 |
| 2,061,217 | * | 11/1936 | Watcher | 269/147 |
| 2,815,053 | * | 12/1957 | Walker | 269/203 |
| 2,930,293 | * | 3/1960 | Muench | 269/203 |
| 4,241,906 | * | 12/1980 | Cole | 269/43 |
| 4,339,113 | * | 7/1982 | Vosper | 269/147 |
| 4,877,228 | * | 10/1989 | Ripert | 269/254 CS |

* cited by examiner

*Primary Examiner*—Timothy V. Eley
*Assistant Examiner*—Lee Wilson
(74) *Attorney, Agent, or Firm*—Bauer & Schaffer, LLP

(57) ABSTRACT

A work vice of a work includes a first moving base slidably attached to a slide guide arranged in parallel with an elongated fundamental base in a longitudinal direction of the fundamental base, a second moving base capable of approaching an advancing direction side of the first moving base and being separated on the advancing direction side and sent out toward an advancing direction of the first moving base by a feed screw attached to the first moving base, a plurality of positioning means arranged at a predetermined pitch in the fundamental base to position and fix a leg portion side of the first moving base, a movable claw arranged on an advancing direction side of the second moving base and gripping one end of a work, and a pent roof portion having a gate shape and integrally formed with an upper portion of the second moving base on the first moving base side, a lower face of the pent roof portion slidably coming in contact with the first moving base on a sliding face parallel to the slide guide.

9 Claims, 19 Drawing Sheets

WORK DEVICE AND ITS MOVEABLE CLAW

BACKGROUND OF THE INVENTION

This invention relates to a work vice used when a work is fixed to a table and a work pallet of a machine tool.

Various kinds of work vices for fixing a work to a table of a machine tool, etc. are generally used in accordance with a structure of the machine tool, a shape and a material of the work, etc. A work vice of a general purpose structure is constructed such that a fixed claw is arranged at one end of a fundamental base thereof fixed to the table of the machine tool, and a movable claw is provided in opposing relation to the fixed claw which the moving claw is moved forward and backward along a slide guide on the fundamental base by a screwing operation of a feed screw. Then, the work is fixedly positioned between the movable claw and the fixing claw.

Therefore, one example of a mounting structure of the above movable claw in the work vice disclosed by the present applicant in Japanese Laid-Open Patent Publication No. 7-171769 will next be explained on the basis of FIG. 1. This mounting structure of the movable claw has a first moving base 18 and a second moving base 19 moved along a slide guide 5 on a fundamental base 3. Further, an upper semicircular knock hole 112 is formed in a leg portion 25 of the first moving base 18, and the knock hole 112 forms a circular knock hole by being opposed to one of plural lower semicircular knock holes 17 formed on the fundamental base 3. The second moving base 19 is the first moving base and the second moving base and can approach the first moving base and can be separated from the first moving base. A movable claw is arranged on a side of the second moving base opposed to the first moving base. A covering roof portion having an arched covering gate shape is provided at an upper portion of the second moving base on its first moving base side. A lower face of a side wall of the pent roof portion and an upper face of the first moving base come in slide contact with each other and form a slide face parallel to the slide guide. Therefore, the length of a structure for supporting the movable claw can be shortened without damaging rigidity. Further, reaction force from a work is applied to an end tip of the cover roof portion and the length of an arm of moment resisting the reaction force is increased. Accordingly, pressure applied to the sliding face is reduced and no excessive force is locally applied so that durability of a work vice device is improved. Further, the sliding face has such-an-action-that it complements the shortening of the guide length of the movable claw by the guide of the fundamental block and the rigidity of the movable claw for the swing in the up and down direction is made high.

In a work vice of a second aspect of the present invention, the pent roof portion of the arched gate shape extends to a side of the first moving base by a length longer than an interval of knock pin holes. An inner face of each of both side walls of the roof portion is set to a guide face coming in slide contact with both side faces of a bearing portion. The sliding face has such an action that it complements the screwed onto a screw rod 23 rotatably inserted into a bearing portion 24 of the first moving base 18. A moving claw 15 is attached to a side of the second moving base 19 opposed to the first moving base 18.

When the work is gripped by this work vice, the upper semicircular knock hole 112 of the first moving base 18 is opposed to one of the lower semicircular knock holes 17 of the fundamental base 3 in conformity with a length of the work. The first moving base 18 is fixed to the fundamental base 3 by inserting a knock pin 29 into a formed circular knock hole. Thereafter, the second moving base 19 screwed onto the screw rod 23 is moved forward and backward toward an opposed fixed claw (not shown in FIG. 1) side by rotating the screw rod 23 pivotally inserted into the first moving base 18. Thus, the work is fixedly positioned between the fixing claw and the moving claw 15 attached to the second moving base 19.

In the work vice of the structure having the first and second moving bases 18, 19 as shown in FIG. 1, a region capable of gripping the work between the movable claw 15 and the fixing claw is narrowed by a length L of the second moving base 19, or the length of the fundamental base 3 must be increased by this length L in comparison with a work vice having only one moving base. Further, when the work fixedly positioned between the movable claw 15 and the fixed claw is cut, cutting powder of the work enters the clearance between the first moving base 18 and the second moving base 19 so that this cutting powder prevents a function of the work vice, etc.

In this case, as shown in FIG. 2, the known of a conventional art, combination of a base block 42 and a claw block 43 is used as the movable claw 15 used in the work vice to more accurately position the work. Namely, this movable claw 15 is formed such that the base block 42 and the claw block 43 can slidably come in contact with each other on a pushing-down face 47 inclined downward. When the work is positioned and fixed by the movable claw 15, the pushing-down face 47 generates component force for pressing the claw block 43 downward by reaction force F from the work so that the work is pressed against an upper face of the fundamental base 3 or an upper face (fixing face) of a spacer arranged on the fundamental base 3. In this case, when the movable claw 15 is opened, a tension spring 44 arranged between the base block 42 and the claw block 43 pulls up the claw block 43.

However, the movable claw 15 of this structure has the following problem. Namely, when the work is gripped by an upper portion of the movable claw 15, the claw block 43 and the base block 42 come in one side contact with each other and no claw block 43 for gripping the work itself is smoothly moved downward so that no work cannot accurately come in press contact with a desirable fixing face. Further, when a gradient of the pushing-down face 47 is increased to smoothly move the claw block 43 downward by the pushing-down face 47, thicknesses for increasing the gradient are required with respect to both the base block 42 on a receiving side and the claw block 43 on a moving side. Therefore, the thickness of the movable claw 15 is increased so that the size of a grippable work is limited. Accordingly, a problem is caused in that the movable claw can be used for only a small work.

An arranging interval of a T-groove of the table of the machine tool is different in accordance with kinds and makers of the machine tool. Accordingly, it is necessary to form fixing bolt holes of the work vice in conformity with the arranging interval of the T-groove of the used table. Therefore, problems exist in that a general purpose property of the work vice is lost and several kinds of work vices conformed to the arranging interval of the T-groove of the table must be prepared.

In a certain kind of working, the working is performed by vertically setting a table face. However, when the work vice is fixed to the vertical table in a horizontal direction, a problem is caused in that the knock pin for fixing the fundamental base and the first moving base drops by its light weight. When the fundamental base and the first moving base are fixed to each other by one knock pin, the dropping of the knock pin can be prevented by inserting a flanged knock pin from above. However, when a large work is gripped by arranging work vices in parallel with each other, there is a case in which a stroke length of the knock pin is restricted by an adjacent work vice. Therefore, it is considered that the length of the knock pin is shortened. When the length of the knock pin is shortened, a structure for inserting knock pins from both sides of a vice is used to avoid an offset between an acting center of fastening force of the vice described later and an engaging position of each of the knock pins. However, in this case, no dropping of a knock pin on a lower side can be prevented.

A work vice having a long fundamental base is characterized in that, when milling working is performed on the surface of a thin work having a complicated peripheral shape, three work vices or more are arranged in parallel with each other and are attached to the table and plural portions of circumferential edges of the work are supported by the fixed claw and the movable claws therebetween so that the work can be stably held. Namely, since each of the work vices has an elongated shape, the plural work vices can be arranged on the table in parallel with each other in accordance with a shape of the work. As shown in FIG. 3 (an example using four conventional work vices), a work 54 having concave and convex circumferential edges can be easily supported and fixed in plural positions A, B, C and D on a table 87. If the work 54 is stably arranged fixedly on the table and intervals of the work vices are determined in consideration of easiness of deformation of the work since the work 54 is supported in the plural positions, the deformation of the work caused by a working reaction force can be minimized and high working precision can be obtained.

When a work vice of the above structure is fixed to the table 87 of the machine tool, a bolt hole of a fixing bolt is formed in a central portion of the fundamental base and the fixing bolt inserted into this bolt hole is fastened to a T-shaped nut on the table side. Otherwise, an inverse L-shaped fixing jig 4 (see FIG. 5) is prepared and a fixing flange 2 of the work vice is pressed by this fixing jig 4.

In accordance with the fixing structure of the work vice using such a fixing jig 4, an interval of the fixing jig 4 can be freely moved in conformity with the arranging interval of a T-groove of the table by moving the fixing jig 4 along the fixing flange 2 of the fundamental base 3. Accordingly, the work vice can be mounted to the table of any machine tool so that a general purpose property of the work vice can be increased. In this case, when the work vice is mounted onto the T-groove in parallel with this T-groove by forming plural bolt holes in the fundamental base 3 on its central axial line, the work vice can be desirably fixed to the table by using fixing bolt holes formed on the central axial line of the fundamental base 3. In a structure of forming the fixing bolt holes at a center of the fundamental base 3, if pin holes 17 of the knock pin are arranged on both sides of the fundamental base 3, it is possible to avoid interferences between the pin holes 17 and the fixing bolt holes formed on the axial line of the fundamental base 3.

When the work 54 is fixed by using three work vices or more and tends to be deformed as in a plate material or the like, the work 54 is deformed at its fastening time even when fixing positions of the work vices onto the table are slightly shifted from each other. Namely, when the thickness of the work 54 is thin, a wavy surface of the work is caused by offsets of the work vices in their longitudinal directions. When the surface of the work 54 in this state is worked into a flat face, the deformation of the work is returned when the work is detached from the work vices, thereby causing a working error.

SUMMARY OF THE INVENTION

The present invention is made to solve the above-mentioned problems.

An object of the invention is to provide a work vice and a movable claw in which a region for supporting a work can be widened and is durable, and entering of cutting powder into a work vice movable portion at a working time can be prevented, and the work can be reliably positioned and is pushed downward without making the work vice come in one side contact with the work at a gripping time of the work so that operability of the work at its attaching and detaching times is improved.

Another object of the invention is to prevent occurrence of a working error as small as possible and is to provide a method for preventing a work from being deformed by an error in relative position accuracy of work vices when the work is supported by three work vices or more therebetween, and a jig for fixing each of the work vices and suitably executing this method.

In a work vice of a first aspect of the present invention, a first moving base and a second moving base are arranged in a slide guide arranged in the longitudinal direction of an elongated fundamental base. The first moving base is positioned by a positioning means formed on the fundamental base at a predetermined pitch. The second moving base is screwed to a screw rod arranged in parallel with the slide guide between shortening of the guide length of the movable claw by the guide of the fundamental block and the rigidity of the movable claw for the swing in the up and down direction is made high. Further, since the roof portion for covering the bearing portion and the distance between the moving bases is provided, it is possible to prevent cutting powder from entering a movable portion of the work vice.

In a work vice of a third aspect of the present invention, a sleeve or a nut member having a trapezoidal screw having a large lead and screwed to the first moving base is interposed between the first moving base and a screw rod for screw-advancing the second moving base. Therefore, the distance between claws can be more rapidly adjusted in accordance with a size of the work, and the work can be more rapidly attached and detached.

A movable claw of a fourth aspect of the present invention is characterized in that the movable claw comprises a base block having a multistage sawtooth shape on its front face, which is constructed by a pushing-down face inclined slantingly downward with respect to reaction force from a work and a receiving face crossing this pushing-down face, and a claw block having a multistage sawtooth shape on its rear face, which is constructed by a downward moving face coming in slide contact with the pushing-down face and a contact face opposed to the receiving face, and a buffer material is interposed between the receiving face and the contact face, and the base block and the claw block are fastened to each other by a screw through a resilient member. The movable claw has the base block and the claw block in which faces having multistage sawtooth shapes come in contact with each other. Accordingly, no one side contact is caused when the work is gripped. Further, a lower face of the work can be pressed against an upper face of the fundamental base as a reference face so that position accuracy of the work can be improved. Further, a gradient of the pushing-down face 47 can be increased without changing a thickness of the movable claw.

A movable claw of a fifth aspect of the present invention is characterized in that the pushing-down face of the base block and the downward moving face of the claw block in the movable claw in the above structure are set to multistage cylindrical faces having one central axis. In this movable claw, in addition to the movable claw in the fourth aspect, the claw block is approximately rotated horizontally with respect to the base block. Accordingly, a work having a tapered side face is reliably gripped while being followed along a horizontal direction. Further, since the pushing-down face and the receiving face are engaged with each other in a multistage sawtooth shape, the lower face of the work is pressed against the reference face of the fundamental base and the work can be more reliably positioned and fixed.

A fixing jig of the work vice of a sixth aspect of the present invention has a pressing flange for pressing a fixing flange of the work vice. The fixing jig also has a slit cut from a side of the pressing flange in a fixing portion to be fixed to a table or a pallet of a machine tool. The fixing jig further has a screw hole for applying screw force to the slit in its enlarging direction. In the fixing jig of this structure, the fixing flange of the work vice is fastened to the table or the pallet by a fixing bolt and is pressed by the pressing flange. Thereafter, force in the enlarging direction of the slit is applied to this slit by rotating a screw inserted to a screw hole. Thus, the pressing flange is deformed upward and force for pressing the fixing flange of the work vice by the pressing flange can be finely adjusted.

A fixing method of the work of a seventh aspect of the present invention is used when the work is fixed to a table or a pallet of a machine tool by mounting three work vices or more. Each of work vices of the three work vices or more in intermediate arrangements of the work is provided by arranging the fixing flange in the fundamental base. This fixing flange is pressed by the fixing jig fixed to the table or the pallet by a bolt so that the work vice is mounted to the table or the pallet. The fixing jig is arranged at a suitable interval in a position inside both longitudinal ends of the work vice so as to press the fixing flange on both sides of the fundamental base in its width direction. When a size of the work in its supporting direction is small and the first moving base of each of the work vices is therefore located near the fixing claw, the fixing jig on a side of the first moving base is located near a side of the fixing claw in accordance with a movement of the first moving base.

Work vices of the three work vices or more at both ends of the work are firmly fixed to the table or the pallet so as not to move these work vices by external force. In contrast to this, the work vices in the intermediate arrangements are fixed to the table or the pallet by adjusting fastening force so as to move the work vices in their longitudinal directions by adjusting force for pressing the fixing flange of each of the work vices by the pressing flange of the fixing jig when external force equal to or greater than a certain strength is applied to each of the work vices. The force for fixing these work vices is determined by an easiness degree of deformation of the gripped work. If necessary, the fixing force of each of the work vices in the intermediate arrangements is determined by measuring the deformation of the work when the work is gripped by the work vices.

When the work is fixed by the three work vices or more fixed onto the table or the pallet of the machine tool as mentioned above, the work is first gripped by the work vices therebetween at both the ends. Thereafter, the work is gripped by the work vices therebetween in the intermediate arrangements. The work vices in the intermediate arrangements are fastened in a state in which these work vices can be moved in their longitudinal directions. Accordingly, when there is an error in relative position of the work vices, a portion between the fixing jig 4 and the fixing flange is slid so that the work vices are moved to their original positions to be located. Further, a supporting reaction force applied from the work to the fixed claw and the movable claw above the fundamental base 3 bends the elongated fundamental base of the work vices in an upward convex direction by further fastening the work. This deformation of the fundamental base is very small. However, both longitudinal ends of the fundamental base of the work vice are pressed against the table or pallet side by this deformation so that pressing force of the fixing jig in its pressing portion is increased by receiving reaction force of this pressing. Accordingly, as a result, the work 55 is supported by the fixed claw 12 and the movable claw therebetween. Thus, the fundamental base of the work vices in the intermediate arrangements is strongly fixed to the table or the pallet by the fixing jig.

In accordance with such a work fixing method, when the work is gripped by the work vices therebetween in the intermediate arrangements, positions of the work vices with respect to the table or the pallet are corrected during a gripping operation. Thereafter, when the work is firmly supported by the fixed claw and the movable claw therebetween, the work vices are strongly fastened to the table or the pallet by the deformation of the fundamental base 3 of the work vices caused by this gripping force. Finally, the work is fixed to the table or the pallet without any influence of deformation caused by an error in attaching position of the work vices.

The invention of each of the first to fifth aspects is disclosed in Japanese Laid-Open Patent Publication No. 9-29571 (laid-open on Feb. 4, 1997) by the same applicant as this application.

BRIEF DESCRIPTION OF THE DRAWINGS

The structure and features of this invention will be easily understood with reference to the following accompanying drawings throughout which the same reference numerals designate the same elements and parts.

DETAILED DESCRIPTION OF THE PREFERRED EMBODIMENTS

Figure 4:
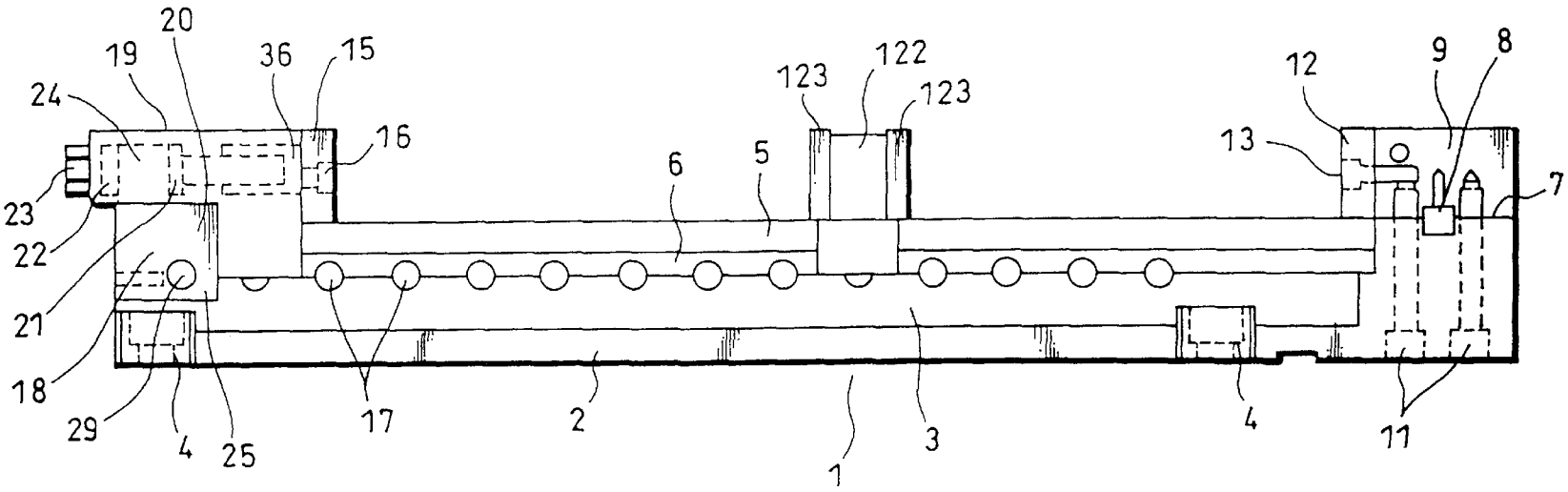
FIG. 4 is a side view showing a first embodiment of a work vice according to the present invention.
Figure 5:
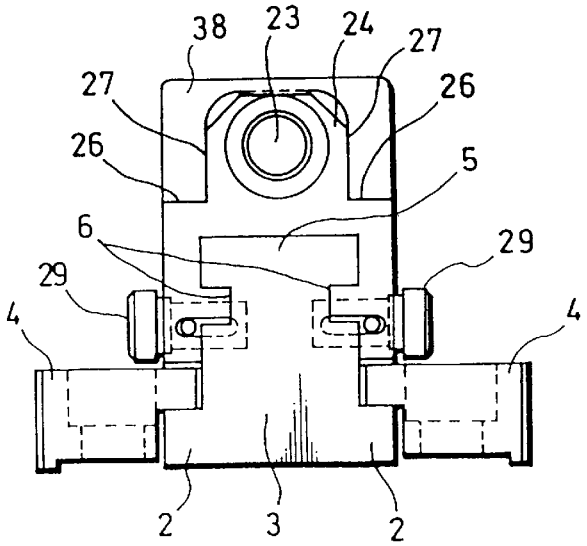
FIG. 5 is a front view showing the first embodiment of the work vice shown in FIG. 4.

FIGS. 4 to 9 show a first embodiment of a work vice according to the present invention. In this first embodiment, a work vice 1 has structures of the first and second aspects. As shown in FIGS. 4 and 5, the work vice of this embodiment has an elongated fundamental base 3 having an inverse T-shape in section and having a flange 2 in each of lower portions on both sides of the base 3. A fixing jig (hook portion) 4 having an inverse L-shape and mounted to a table of a machine tool (not shown in FIGS. 4 to 9) is engaged with the fixing flange 2 so that the work vice 1 is fixed to the table. A slide guide 5 having a T-shape in section is formed integrally with an upper face of the fundamental base 3. Concave grooves 6, 6 extending in a longitudinal direction of the fundamental base 3 are formed on both sides of a connecting portion of the slide guide 5 and the fundamental base 3.

As shown in FIG. 4, an attaching face 7 as the same face as an upper face of the slide guide 5 is formed at one end of the above fundamental base 3. A block body 9 is fixed by a bolt 11 to this attaching face 7 through a key 8. A fixed claw 12 is fixed to the block body 9 by a screw 13. A movable claw 15 opposed to the fixed claw 12 is fixed by a screw 16 to a second moving base 19 slidably mounted to the slide guide 5. A first moving base 18 is slidably mounted to the slide guide 5 such that the first moving base 18 is adjacent to a side of the second moving base 19 opposed to a side of the fixed claw 12. A plurality of knock holes 17 having centers near lower sides of the concave grooves 6 are formed on both side faces of the fundamental base 3 at a constant pitch along the slide guide 5. A depth of each of the knock holes 17 is set to be deeper than the depths of the concave grooves 6.

Figure 6:
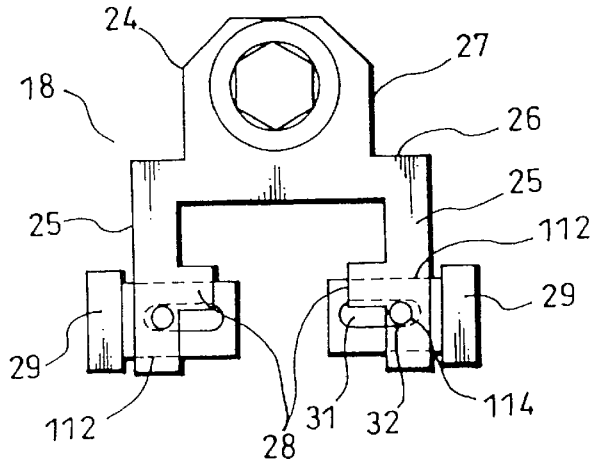
FIG. 6 is a front view of a first moving base shown in FIG. 4.
Figure 7:
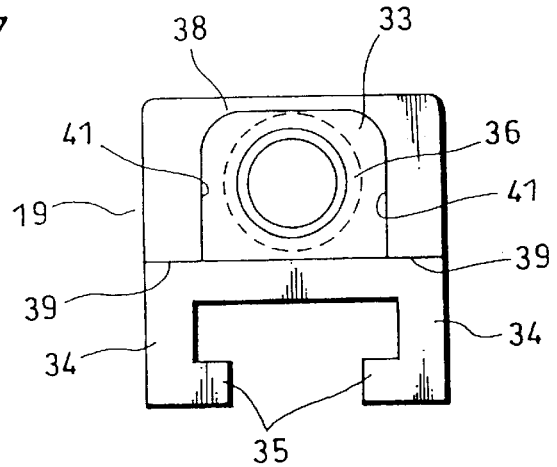
FIG. 7 is a front view of a second moving base shown in FIG. 4.
Figure 8:
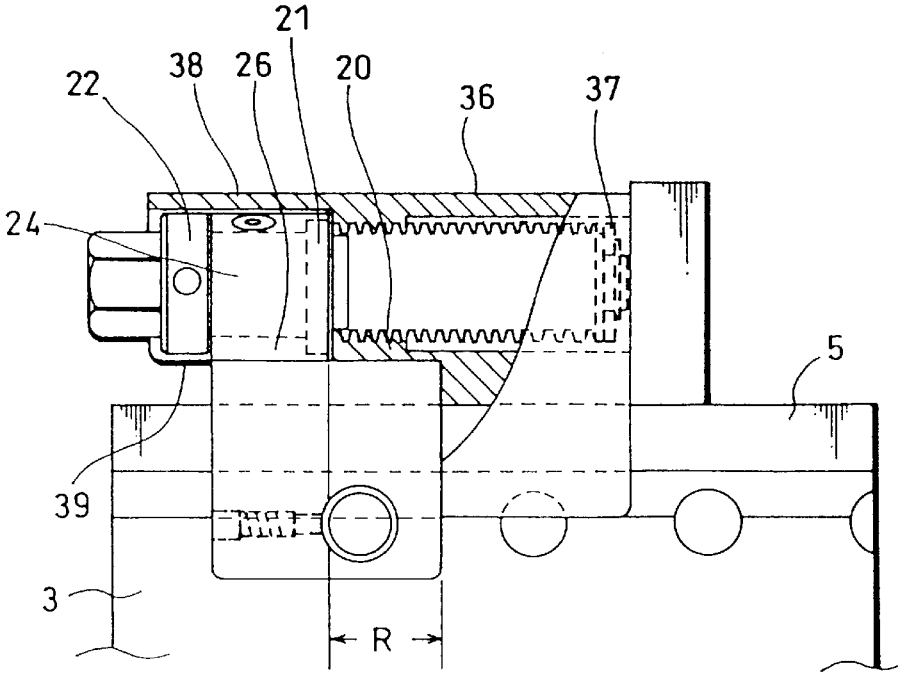
FIG. 8 is a partially broken side view of the first and second moving bases when the first and second moving bases approach each other.
Figure 9:
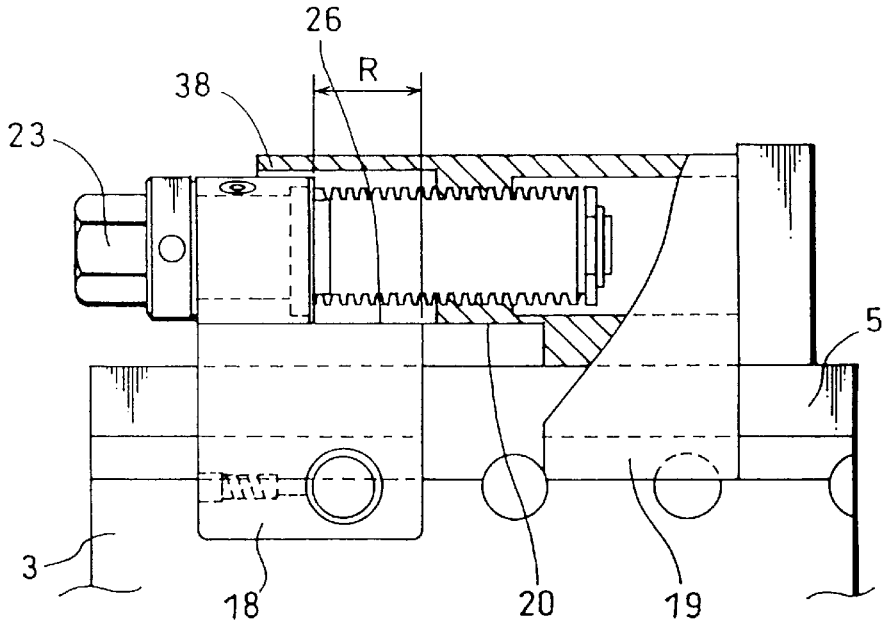
FIG. 9 is a partially broken side view of the first and second moving bases when the first and second moving bases are separated from each other.

FIGS. 6 and 7 respectively show the first moving base 18 and the second moving base 19. As shown in FIGS. 8 and 9, a roof portion 38 having an arched gate shape extends above the first moving base 18 integrally with an upper portion of the second moving base 19 to its first moving base 18 side. An upper face of the first moving base 18 and a lower face of a side wall of the roof portion 38 come in slide contact with each other and form a slide face 20 parallel to the slide guide 5.

As shown in FIG. 6, the first moving base 18 has a bearing portion 24 for rotatably and pivotally supporting a screw rod 23 and also has a leg portion 25 coming in slide contact with each of both side faces of the slide guide 5. An axial movement of the screw rod 23 is restricted by a flange 21 and a collar 22 (See FIG. 8) located on both sides of the bearing portion 24 so that the screw rod 23 can not be axially moved. A width of the bearing portion 24 is narrower than that of the leg portion 25. Both shoulder faces of the leg portions 25 located on sides of the bearing portion 24 are set to slide faces 20. A projection 28 fitted into each of the concave grooves 6 is formed in an intermediate position inside each of the two leg portions 25, 25 on both the sides of the bearing portion 24.

A knock pin 29 fitted into each of the knock holes 17 of the fundamental base 3 is mounted to each of the leg portions 25 both the sides such that the knock pin 29 can be depressed and projected toward an inner side of each of the leg portions 25. A long groove 31 in the direction of a pin axis is formed in the knock pin 29, and an end portion of a basic end portion (a picking side) of this long groove 31 is set to a concave 114 deeper than the depth of this groove 31. The length of the long groove 31 is set to be equal to an inserting stroke of the knock pin 29. An engaging pin 32 is faced to a side face of a through hole 112 of the leg portion 25 of the first moving base 18 and is biased by a spring (not shown) in an advancing direction thereof. An end tip of the engaging pin 32 is projected to the leg portion 25 of the first moving base 18. This end tip of the engaging pin 32 is fitted into the above long groove 31 of the knock pin 29 inserted into the through hole 112. When this end tip is opposed to the concave 114, this end tip is further advanced and is dropped into the concave 114. The above long groove 31 of the knock pin 29 is formed such that the end tip of the engaging pin 32 is opposed to the concave 114 when the knock pin 29 is fully inserted. The above long groove 31 of the knock pin 29 is also formed such that the end tip of the engaging pin 32 reaches the other end of the long groove 31 when the knock pin 29 is pulled out and the end tip of the knock pin 29 is returned until the through hole 112. When the first moving base 18 is moved along the slide guide 5 and such a knock pin 29 is pushed-in at a desirable fixing position, the end tip of the engaging pin 32 and the concave 114 are fitted to each other so that an axial movement of the knock pin 29 is prevented. Accordingly, pulling-out of the knock pin 29 is prevented by vibrations, etc. At the same time, when the work vice is horizontally mounted to the table 87 (See FIG. 3) located in a vertical position, it is also possible to prevent the knock pin 29 on a lower side of the work vice from dropping by its light weight. Further, when the knock pin 29 is pulled out, pulling-out of the knock pin 29 is prevented in a contact position between the end tip of the engaging pin 32 and the other end of the long groove 31 after the end tip of the engaging pin 32 is pulled out of the concave 114 by pulling force of the knock pin 29. Therefore, no knock pin 29 is detached from the through hole 112. Accordingly, when the first moving base 18 is moved to a new position, the pin hole 17 and the knock pin 29 are easily aligned with each other in position and the first moving base 18 can be more smoothly positioned.

The above second moving base 19 has a female screw portion 33 screwed to the screw rod 23 pivotally supported by the first moving base 18 and also has a skirt portion 34 coming in slide contact with each of the side faces of the slide guide 5. A convex fitting portion 35 fitted into each of the concave grooves 6 is formed inside a lower end of each of the skirt portions 34.

The female screw portion 33 is formed in a portion of the above pent roof portion 38 of the second moving base 19. A fixed claw 12 side of the female screw portion 33 is formed to be a counter boring hole 36. The screw rod 23 is projected from the female screw portion 33 to the counter boring hole 36. A washer 37 for preventing the screw rod 23 from pulled out of the female screw portion 33 is mounted to an end tip of the screw rod 23 (see FIG. 8). The movable claw 15 is mounted such that the movable claw 15 closes this counter boring hole 36.

The above roof portion 38 having the an arched gate shape in section extends from an upper portion of the second moving base 19 onto a side of the first moving base 18 such that the bearing portion 24 of the first moving base is covered with the roof portion 38. A lower face of this roof portion 38 comes in slide contact with an upper portion of the first moving base 18 and becomes the slide face 20. An inner face 41 of each of the side walls of the roof portion 38 comes in slide contact with each of the side faces of the bearing portion 24 and becomes a guide face 27. A length of the roof portion 38 is set to be slightly longer than the arranging pitch of the knock holes 17 of the fundamental base 3. The roof portion 38 is formed such that no roof portion 38 is dislocated from the bearing portion 24 even when the first moving base 18 and the second moving base 19 are separated from each other. The roof portion 38 is also formed such that entering of cutting powder into a movable portion between the first moving base 18 and the second moving base 19 is prevented.

When the work is gripped by the work vice 1 of the first embodiment, the work is arranged on the slide guide 5 in a state in which one side face of the work comes in contact with the fixed claw 12. Then, the first moving base 18 is fixed by making the movable claw 15 approach the work and fitting the knock pin 29 into a nearest knock hole 17. Next, the second moving base 19 is advanced by rotating the screw rod 23 so that the work is gripped by the movable claw 15 and the fixed claw 12. When the work is gripped between these claws, reaction force is applied to the movable claw 15 such that the second movable base 19 falls on a side of the moving claw 15. However, this falling of the second moving base 19 is received on the slide face 20 so that this falling can be effectively prevented even when the width of the second moving base 19 in its sliding direction is narrowed. Accordingly, a compact vice having high rigidity is obtained.

Figure 10:
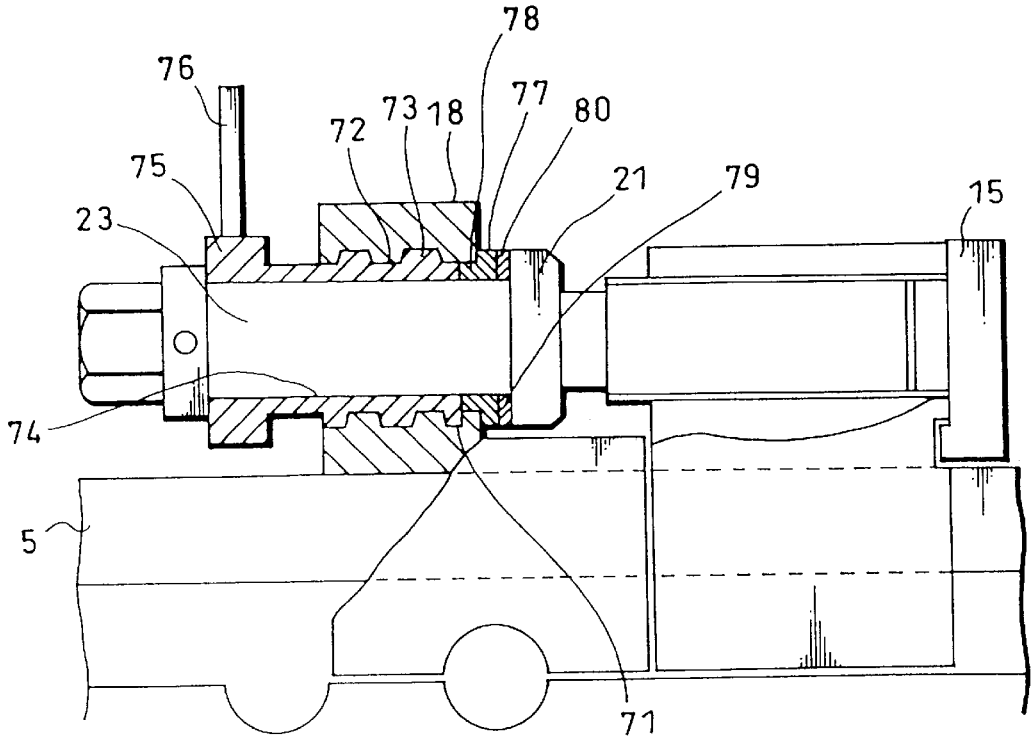
FIG. 10 is a partially broken side view showing a second embodiment of the work vice according to the present invention.

FIG. 10 shows a work vice according to a second embodiment of the present invention which has a structure of the third aspect of the present invention in which a connecting portion of the first moving base 18 and a movable claw holder 86 is improved. In this second embodiment, a female screw hole 71 parallel to the slide guide 5 is formed in the first moving base 18. A trapezoidal female screw 72 having a large head is provided in this female screw hole 71. A sleeve 73 having a trapezoidal male screw to be screwed into the above trapezoidal female screw 72 formed on an outer circumference of the sleeve 73 is screwed into the above female screw hole 71. The screw rod 23 having the flange 21 in its intermediate portion is inserted into a central through hole 74 of the sleeve 73.

A thrust washer 77 is fitted into an end tip of the sleeve 73 by locking rotation of the thrust washer 77 by a pin 78. A thrust metal 80 having a lubricant impregnating portion 79 is interposed between this thrust washer 77 and the pin 78 in a free rotating state. The thrust metal 80 is provided to reduce frictional force between the thrust metal 80 and the sleeve 73 when the screw rod 23 is rotated. The thrust washer 77 is provided to secure a required pressure receiving area between the thrust washer 77 and the thrust metal 80.

The sleeve 73 has a head 75 at the other end thereof. A short lever 76 is fixed to this head 75. The sleeve 73 is moved forward and backward within the female screw hole 71 by rotating this lever 76 so that the screw rod 23 can be moved forward and backward by a large stroke.

Figure 11:
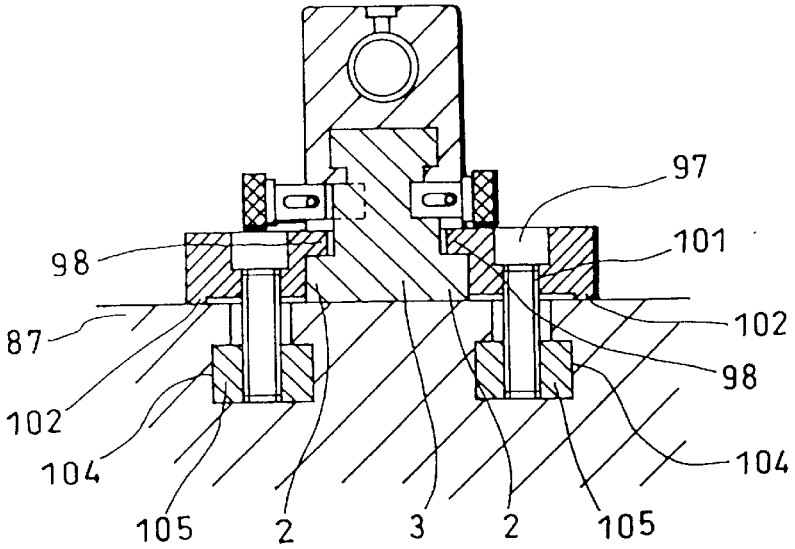
FIG. 11 is a cross-sectional view typically showing a fixing method of the work vice.

FIG. 11 shows an attaching structure of the work vice of the present invention to the table. In FIG. 11, the fundamental base 3 is fixed to the table 87 by a fixing jig 4 having a pressing flange 98 coming in contact with the upper face of the fixing flange 2 of the fundamental base 3. The fixing jig 4 has a fixing bolt hole 101 in its central portion and a fulcrum leg 102 is formed on a side opposed to the pressing flange 98. A fixing bolt 97 is inserted into the fixing bolt hole 101 and is fastened to a nut member 105 mounted in a T-groove 104 of the table 87 in a state in which the fulcrum leg 102 comes in contact with an upper face of the table 87 and the pressing flange 98 comes in contact with the upper face of the fixing flange 2. Thus, an end portion of the fundamental base 3 is fixed. When the fundamental base 3 is fixed to the table 87 by using a fixing bolt hole (not shown) formed in the fundamental base 3, a tee to be fitted to the T-groove 104 of the table 87 is fixed onto a bottom face of the fundamental base 3 so that an attaching position of the work vice is prescribed. Such an arranging structure of the T-groove 104 is convenient as a mutual positioning structure of work vices when two work vices are arranged in parallel with each other.

When a work vice is large-sized, etc., the work vice can be of course fixed by using one fixing screw and four fixing jigs 4 or more for directly fixing the fundamental base 3. When plural fixing bolt holes are formed on a central axial line of the fundamental base 3 together with the fixing jigs 4 for fixing the fundamental base 3 and the work vice is mounted in parallel with the T-groove of the table, the work vice can be also fixed to the table by using these bolt holes. At this time, if necessary, the plural fixing bolt holes can be arranged at a short pitch so as to cope with differences in arranging interval of the T-grooves of the table to a certain extent. Further, the work vice can be also fixed to the table by only plural fixing jigs although an error in fixing position is large.

In accordance with the above fixing structure of the work vice to the table, the work vice can be fixed to various kinds of T-grooves having different arranging intervals, and the work vice can be freely mounted in any one of directions parallel and perpendicular to the T-grooves of the table so that a general purpose property of the work vice can be improved.

Figure 12:
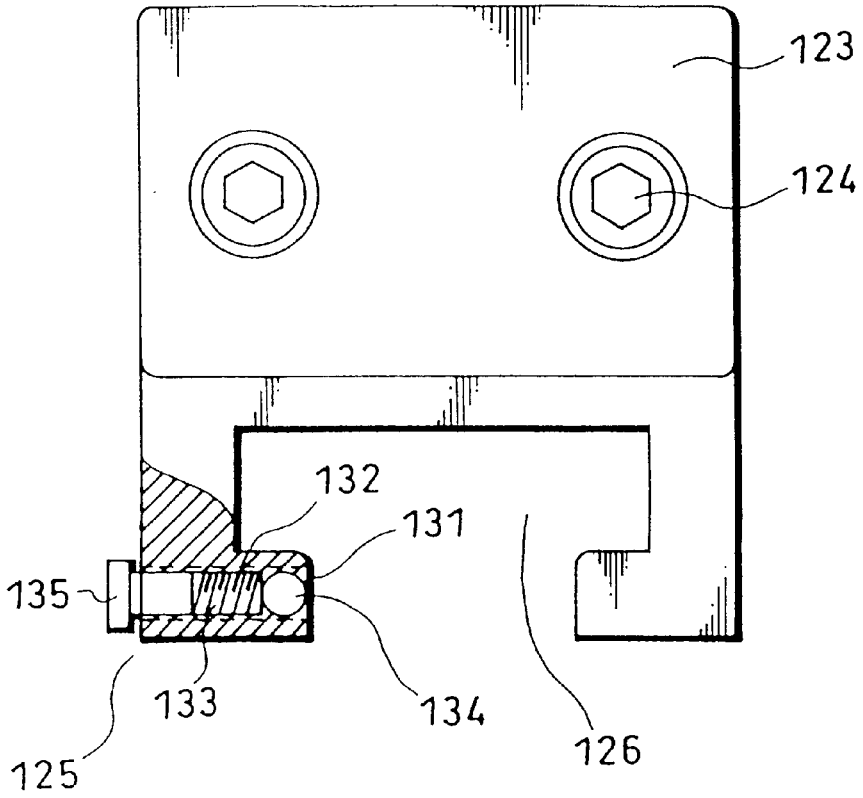
FIG. 12 is a partially broken front view showing an intermediate claw holder.

As shown in FIG. 4, when an intermediate claw holder 122 is mounted in an intermediate position between the fixed claw 12 and the movable claw 15, two works can be simultaneously gripped between these claws. FIG. 12 shows a structure of this intermediate claw holder 122. Similar to the first moving base 18 and the movable claw holder 86 mentioned above, this intermediate claw holder 122 has a T-groove 126 slidably moved along the slide guide 5, and an intermediate claw 123 is fixed to the intermediate claw holder 122 by a bolt 124 at its both faces directed to sides of the fixed claw 12 and the movable claw 15. Further, an engaging means 125 is provided for fastening the fundamental base 3 and fixing the relative position of the intermediate claw holder 122 to the fundamental base 3 by frictional force therebetween. The engaging means 125 can be constructed by using a screw. However, the engaging means 125 can be also constructed such that a ball hole 132 having an end tip opening portion 131 directed to the fundamental base 3 is formed in a projecting portion of the T-groove 126 and a guide ball 134 biased by a spring 133 is rotatably fitted into the ball hole 132 so as to partially project the guide ball 134 from the above end tip opening portion 131. In this case, a pressure adjusting screw 135 for adjusting a compression length of the spring 133 can be arranged on a side of the spring 133 opposed to the guide ball 134. When the latter structure is employed, the guide ball 134 is rotatably pressed against the fundamental base 3 of the work vice by the spring 133. Accordingly, the intermediate claw holder 122 can be moved to a free position in a longitudinal direction of the fundamental base 3. Further, the intermediate claw holder 122 can be temporarily fixed at the free position in the longitudinal direction of the fundamental base 3 only by separating a hand from the pressure adjusting screw 135 so that the work can be attached and detached rapidly and easily.

The intermediate claw 123 is formed to simultaneously fix two works between the fixed claw 12 and the movable claw 15. When only one work is fixed, the first moving base 18 and the movable claw holder 86 are pulled out of the slide guide 5 and the intermediate claw holder 122 is then pulled out from the slide guide 5. The first moving base 8 and the movable claw holder 86 are again inserted into the slide guide 5.

This intermediate claw 123 is particularly suitable when the movable claw 15 of the work vice is mounted to the attaching faces of the work in the longitudinal direction thereof and are opposed to each other in a vertical direction and two works are arranged in the vertical direction and are simultaneously gripped. When the works are attached in this way, a position of the intermediate claw 123 can be also fixed by the engaging means 125 in a detaching state of the works. Accordingly, after the next work to be mounted at a lower side of the intermediate claw 123 is set, another work is set onto an upper side of the intermediate claw 123 and the movable claw 15 is advanced (lowered) so that the upper and lower works can be simultaneously fixed smoothly.

When the works are released, the movable claw 15 is moved backward. Thereafter, the upper work is detached and the intermediate claw 123 is slightly raised upward and is fixed by the engaging means 125. The lower work is then detached. This construction is characterized in that the two works can be simultaneously gripped reliably in a stable state by existence of the intermediate claw 123.

As mentioned above, the intermediate claw 123 is held by the slide guide 5 by a structure in which the intermediate claw 123 is provided on the slide guide 5. Therefore, the two works gripped on both sides of the intermediate claw 123 can be stably gripped therebetween. For example, when the work vice is used by setting this vice in the vertical direction, etc., the intermediate claw 123 can be held in a temporary position by the engaging means 125 at attaching and detaching times of the works. Accordingly, the works can be smoothly attached and detached rapidly even when the two works having different shapes are simultaneously gripped in the vertical direction.

Figure 13:
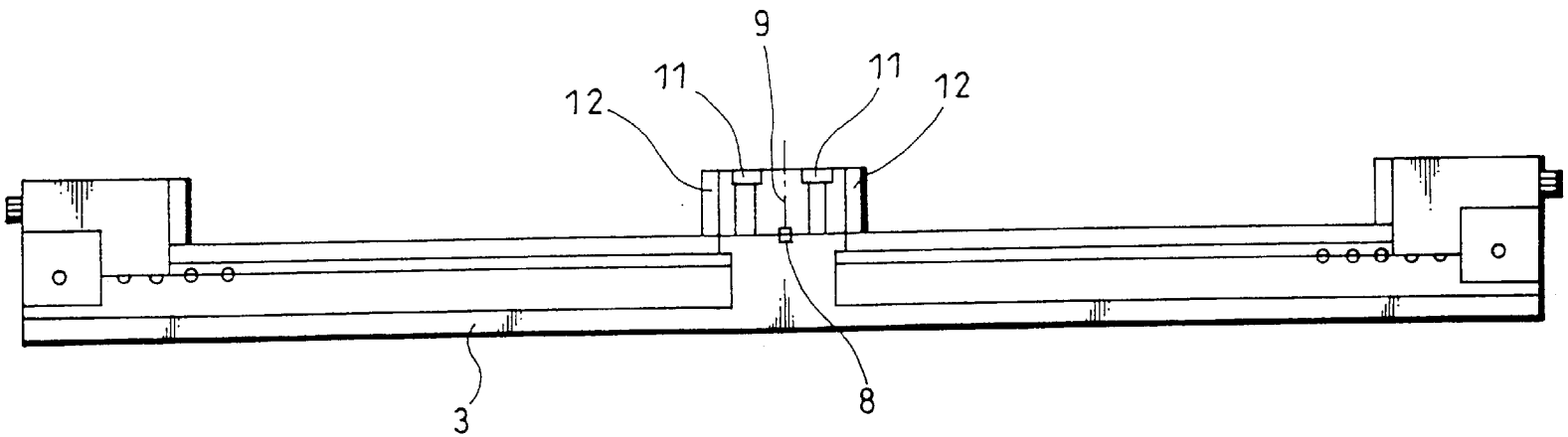
FIG. 13 is a side view showing a third embodiment of the work vice according to the present invention.
Figure 14:
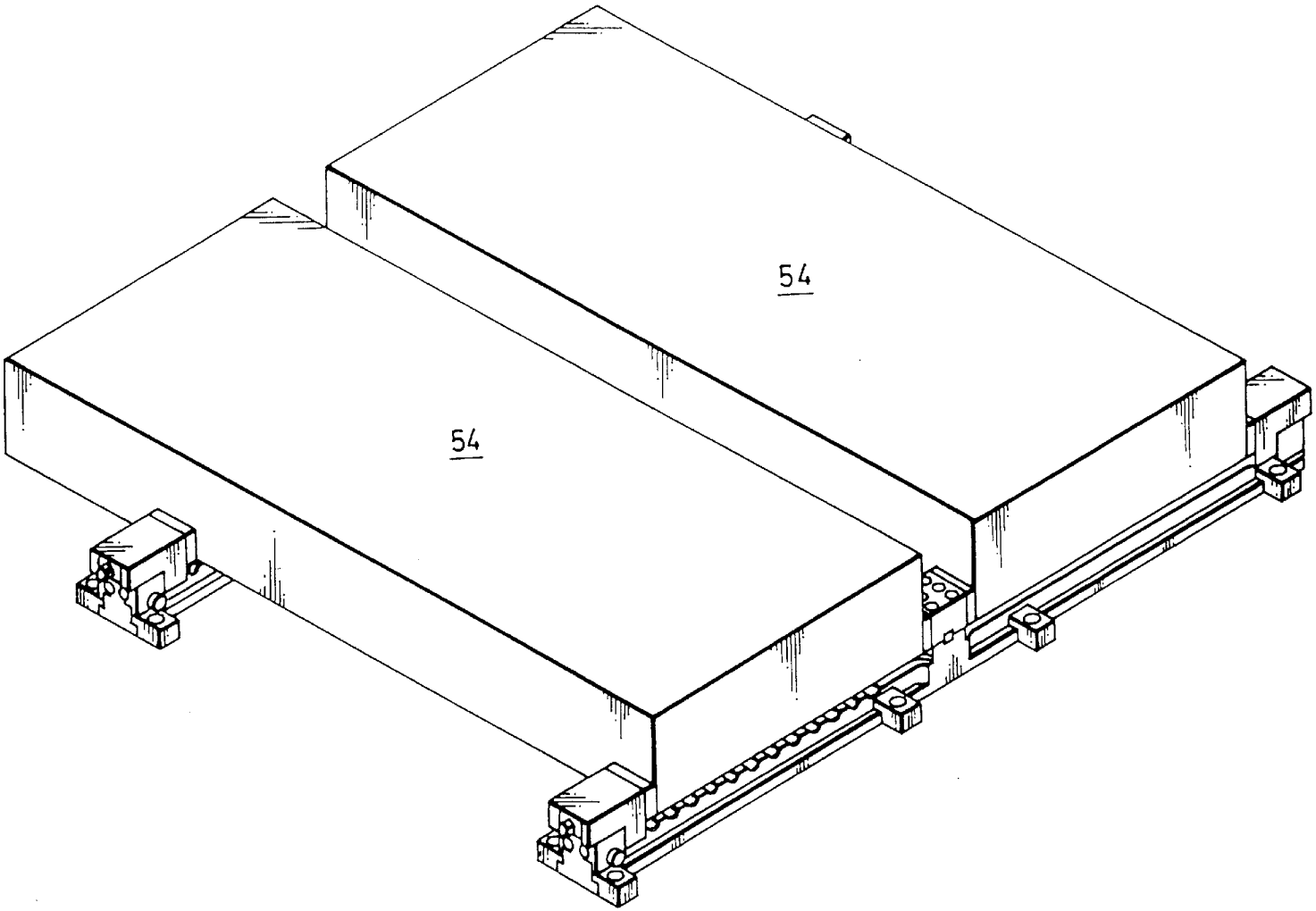
FIG. 14 is a perspective view showing a using state of the work vice of the third embodiment.
Figure 15:
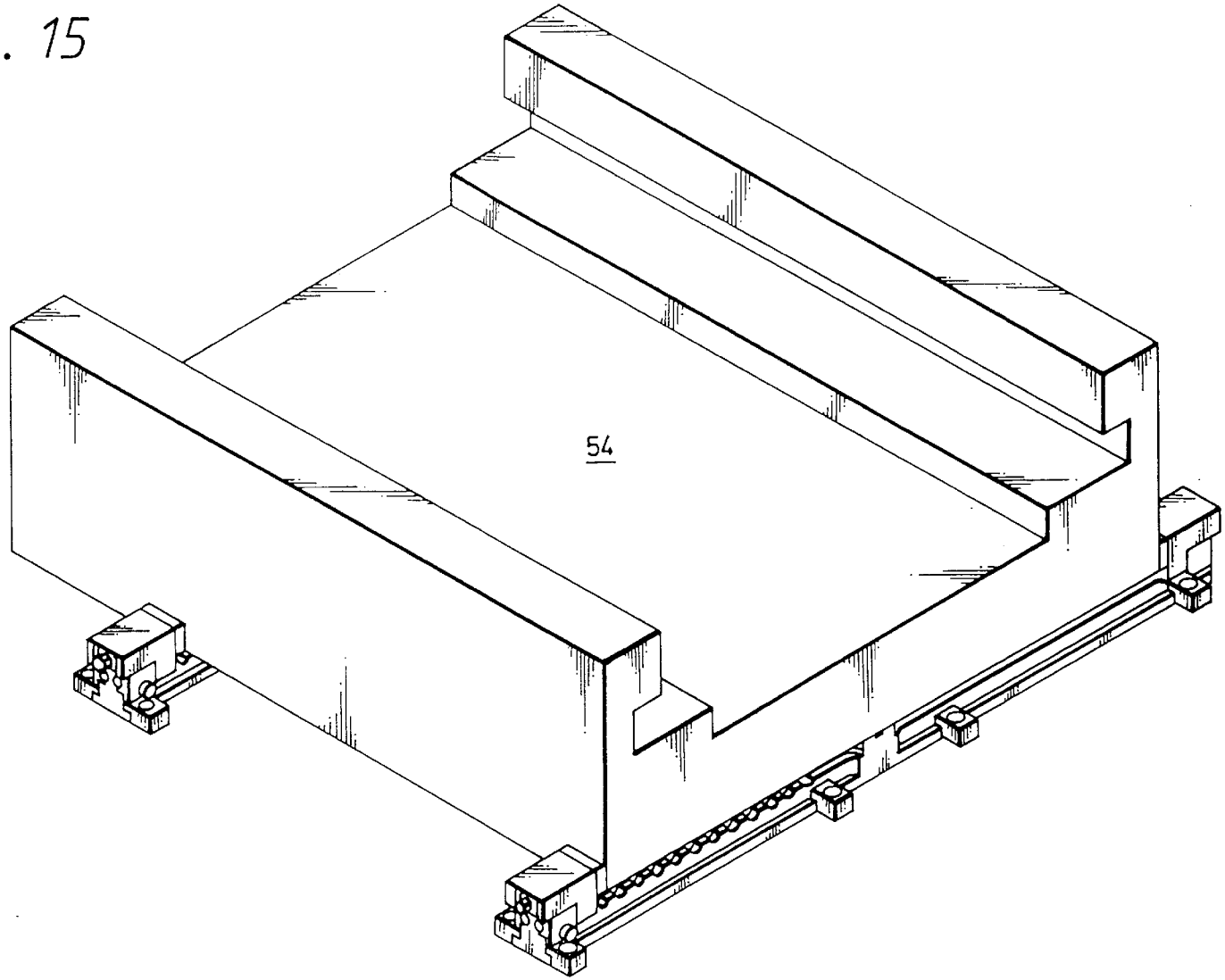
FIG. 15 is a perspective view showing a modified embodiment of the work vice of the third embodiment.

FIGS. 13 to 15 show a third embodiment of the work vice having structures of the first to third aspects of the present invention. In the work vice of this embodiment, a fixed claw 12 is detachably arranged in an intermediate position of an elongated fundamental base 3 and a movable claw 15 is arranged at both ends of the fundamental base 3. A block body 9 is fixed to a center of the fundamental base 3 by a bolt 11 and fixing claws 12, 12 are fixed to both sides of this block body 9. A first moving base 18 and a second moving base 19 similar to those in the first embodiment are arranged in both side end portions of the fundamental base 3. The movable claw 15 is fixed to the second moving base 19. In a mounting state of the block body 9, two works 54, 54 can be gripped as shown in FIG. 14. In a detaching state of the block body 9, a large-sized work 54 can be gripped as shown in FIG. 15.

Figure 16:
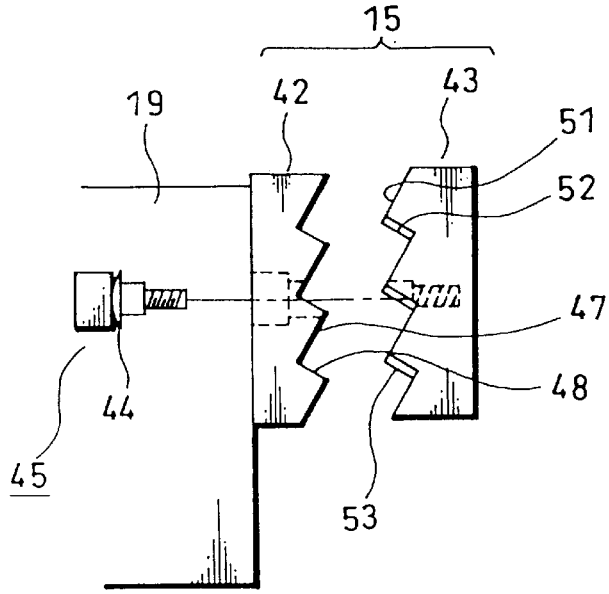
FIG. 16 is an exploded side view showing a first embodiment of a movable claw according to the present invention.
Figure 17:
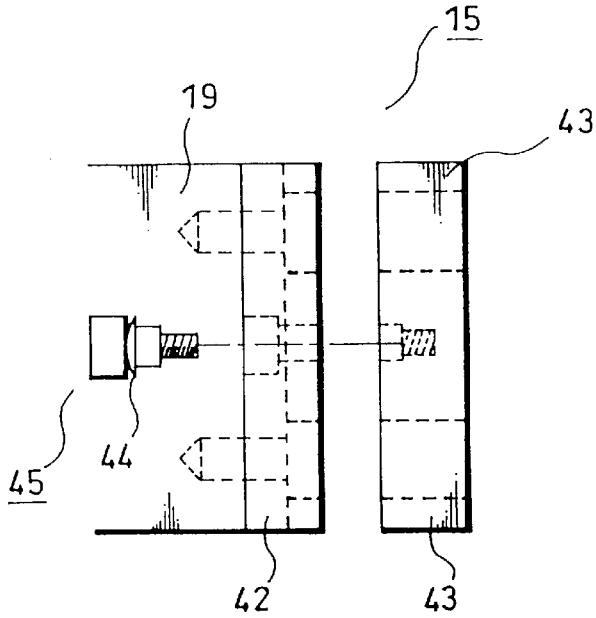
FIG. 17 is an exploded plan view of the movable claw of the first embodiment.

FIGS. 16 and 17 show a detailed structure of the movable claw in the first embodiment of the present invention. The movable claw 15 of this first embodiment has a structure of the fourth aspect of the present invention. The movable claw 15 is constructed by a base block 42 to be fixed to a side of the second moving base 19 and a claw block 43 on a work side. Both the blocks 42, 43 are fastened to each other by a stepped screw 45 in which a belleville spring 44 is interposed. A front face of the base block 42 has a multistage sawtooth shape and has a slanting pushing-down face 47 and a receiving face 48 perpendicular to this pushing-down face 47.

A rear face of the claw block 43 is formed in a sawtooth shape vertically reverse to the front face of the base block 42 and has a downward moving face 51 coming in slide contact with the above pushing-down face 47 and a contact face 52 opposed to the receiving face 48. A rubber sheet 53 having an oil proof property is additionally attached to the contact face 52. The base block 42 and the claw block 43 come in press contact with each other by the belleville spring 44 of the stepped screw 45 through the rubber sheet 53.

In accordance with the movable claw 15 of this first embodiment, when the movable claw 15 is mounted to the second moving base 19 and a work is gripped between the movable claw 15 and the fixed claw 12, the claw block 43 is slightly swung slantingly downward along the pushing-down face 47 by reaction force applied from the work to the claw block 43. Thus, floating-up of the second moving base 19 can be absorbed and the work can be pressed against the reference (an upper face of the slide guide 5) so that positioning accuracy of the work can be improved.

Figure 18:
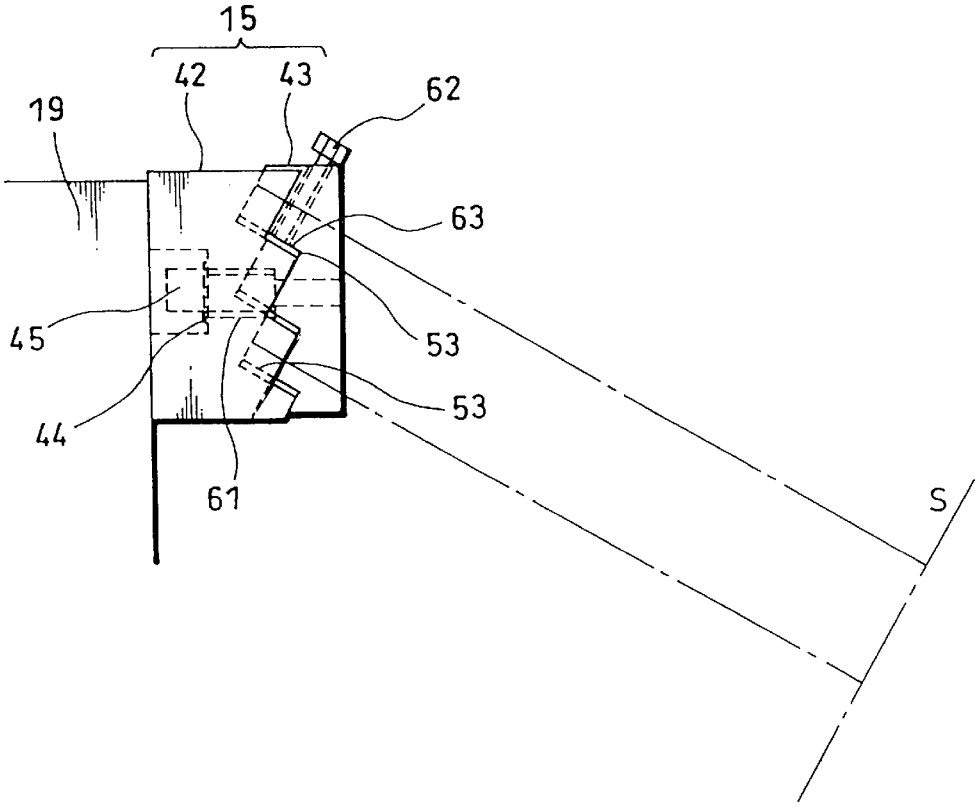
FIG. 18 is a side view showing a second embodiment of the movable claw according to the present invention.
Figure 19:
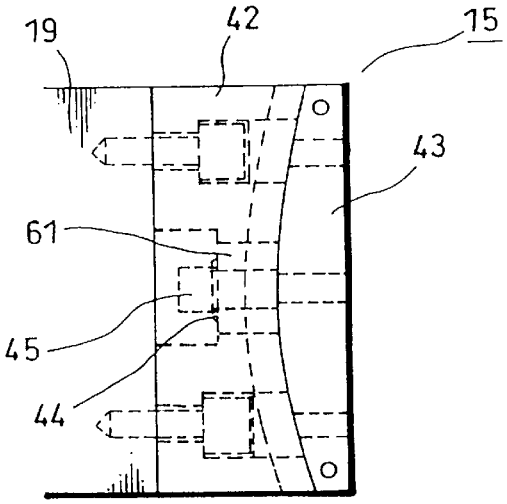
FIG. 19 is a plan view of the movable claw of the second embodiment.
Figure 20:
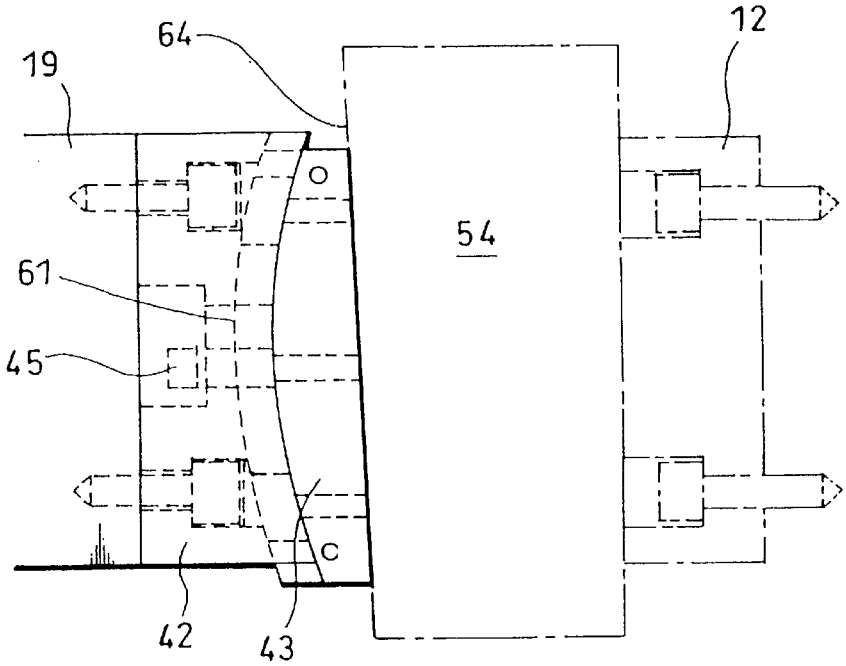
FIG. 20 is a plan view showing a using state of the movable claw of the second embodiment.

FIGS. 18 to 20 show a second embodiment of the movable claw 15. The movable claw 15 of this second embodiment has a structure of the fifth aspect of the present invention. In the movable claw 15 of this embodiment, the pushing-down face 47 of the base block 42 and the downward moving face 51 of the claw block 43 are formed by cylindrical faces at plural stages having a slanting central axis S parallel to a front pushing-down face of the claw block 43. Accordingly, each of sawtooth shapes of the base block 42 and the claw block 43 is set to a gentle angular shape having low both ends and a high center. A stepped screw 45 screwed into the claw block 43 is inserted into an elongated hole 61 extending in a transversal direction at a center of the base block 42. The claw block 43 and the base block 42 are fastened through a belleville spring 44. A stopper bolt 62 is projected from a contact face 52 at a first stage at its end tip and is screwed into each of both upper corners of the claw block 43. The end tip of the stopper bolt 62 extends until an intermediate portion of a through hole 63 formed in a rubber sheet 53. The rubber sheet 53 can be shrunk and the end tip of the stopper bolt 62 is set such that this end tip is not broken by pressure.

When a work 54 having a tapered side face 64 (see FIG. 20) is gripped by the movable claw 15 of the above second embodiment and the movable claw 15 comes in contact with the work 54, the claw block 43 is approximately rotated in a horizontal direction around the central axis S along the tapered side face 64 of the work 54. At this time, the stepped screw 45 is also moved within the elongated hole 61 of the base block 42. After the claw block 43 is moved along the tapered side face 64 and the screw rod 23 is further rotated, the claw block 43 is moved downward along the pushing-down face 47 while the claw block 43 compresses the rubber sheet 53. Thus, a bottom face of the work 54 is pressed against the slide guide 5. When the rubber sheet 53 is compressed to a certain extent, an end tip of the stopper bolt 62 is projected from the through hole 63 and comes in contact with the receiving face 48 of the base block 42 so that the downward movement of the claw block 43 is stopped. Accordingly, this movable claw 15 is rotated in the horizontal direction along the tapered side face 64 of the work 54 and its positioning in a vertical direction is adjusted by the downward movement along the pushing-down face 47 of the claw block 43. Accordingly, the work can be more reliably positioned and fixed in comparison with the movable claw in the first embodiment.

Figure 21:
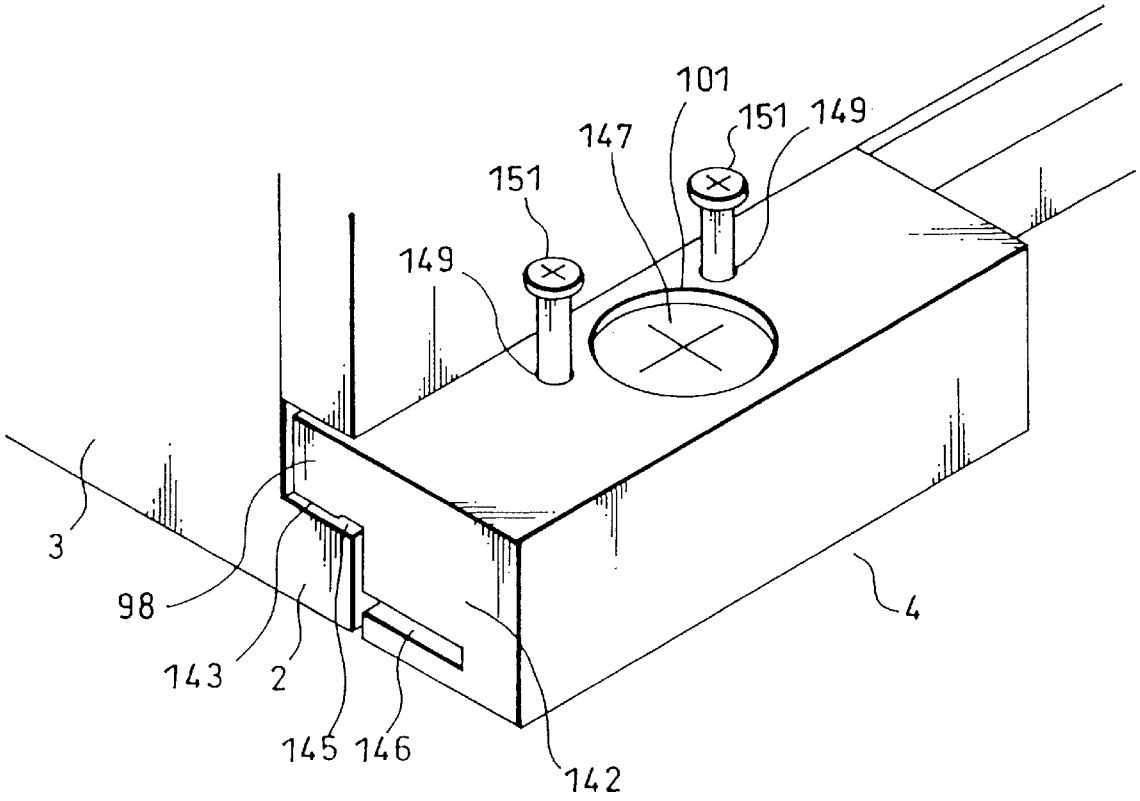
FIG. 21 is a perspective view showing a fixing jig.

FIG. 21 shows an embodiment of the fixing jig 4 of the work vice according to the present invention. The fixing jig of this embodiment has a structure of the sixth aspect of the present invention. A side face of the fixing jig 4 of this embodiment is formed in an inverse L-shape. The fixing jig 4 has a low fixing portion 142 having a flat bottom face and approximately formed in a rectangular parallelepiped shape. The fixing jig 4 also has a pressing flange 144 projected from an upper portion of the fixing portion 142 and having a pressing face 143 parallel to the bottom face of the fixing portion 142. A concave portion 145 is formed as an escaping portion at a working time on a portion of the pressing face 143 crossing a side face of the fixing portion 142. A slit 146 is cut in parallel with the bottom face of the fixing portion 142 on its side face to pressing flange 144 side until a portion near a central portion of the fixing portion 142. A bolt hole 148 is formed in a vertical direction near an upper central face of the fixing portion 142. A fixing bolt 147 for fastening the fixing jig 4 to the table 87 is inserted into the bolt hole 148. Each of two screw holes 149 is formed on an upper face of the fixing portion 142 and reaches the slit 146 in a position displaced the pressing flange 144 side with respect to the bolt hole 148.

When the work vice 1 is fixed to the table 87 by the fixing bolt 147, the fixing flange 2 of the work vice is pressed by the pressing face 143. The pressing face 143 can strongly press the fixing flange 2 since a slit width of the slit 146 is slightly reduced as the fixing bolt 147 is screwed forward. Pressing force of the pressing flange 144 is finely adjusted by a screwing movement of a screw 151 screwed into each of the screw holes 149. The screw 151 is screwed into the screw hole 149 until the screw 151 comes in contact with a bottom face of the slit 146. Thereafter, when the screw 151 is further screwed forward, the slit 146 is enlarged and height of the fixing portion 142 is increased and the pressing flange 144 is raised upward so that the pressing force thereof is weakened. In contrast to this, when the screwed screw 151 is screwed backward, the slit 146 is narrowed in width and the pressing flange 144 is lowered so that the pressing force thereof is strengthened.

Figure 1:
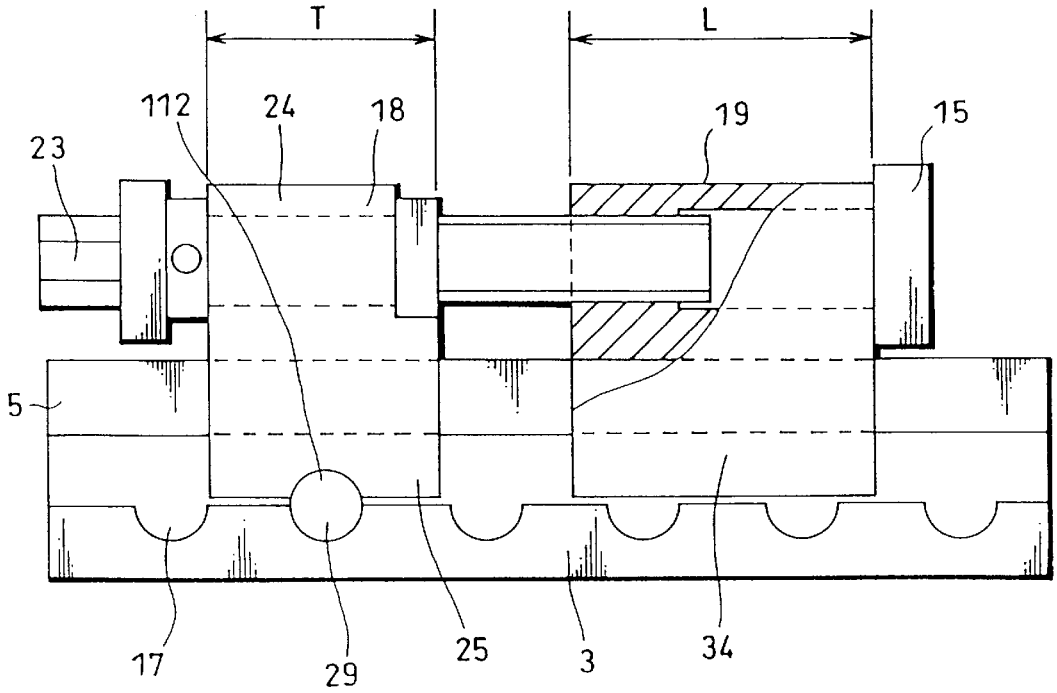
FIG. 1 (Prior Art)
FIG. 1 is a partially broken side view of a work vice of a conventional structure.
Figure 2:
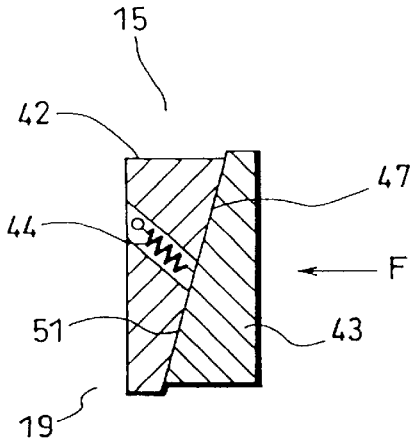
FIG. 2 (Prior Art)
FIG. 2 is a front view showing a conventional movable claw.
Figure 3:
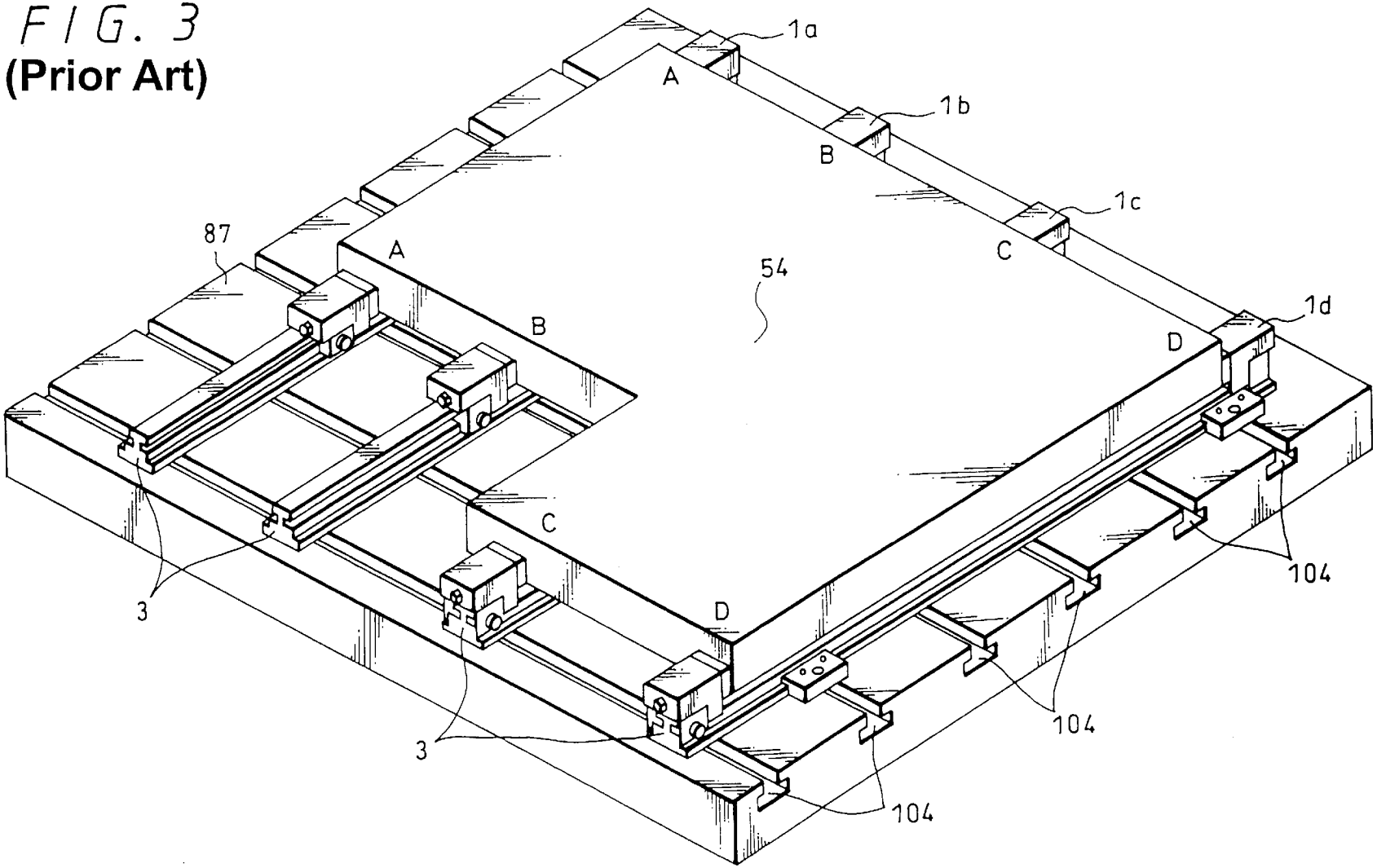
FIG. 3 (Prior Art)
FIG. 3 is a perspective view showing a fixing method of a work.

FIG. 3 shows a state in which a work 54 having a planar L-shape is fixed by using four work vices 1*a* to 1*d*. A fixing method of the work of the seventh aspect of the present invention will next be explained with reference to FIG. 3 and FIG. 21.

Four work vices 1*a*, 1*b*, 1*c* and id are strongly fixed to the table 87 by the fixing jig 4 and the fixing bolt 147. An attaching position of the fixing jig 4 is adjusted by the length of the work 54 in the longitudinal direction of the work vice. In this embodiment, four fixing jigs per one work vice are attached to both sides of the fundamental base 3 near end portions of the work 54. Each of the fixing jigs 4 for the two work vices 1*b*, 1*c* in intermediate portions of the work 54 is fixed to the table 87 by the bolt 147 and the screw 151 is then inserted and screwed forward so that the pressing force is weakened by a certain strength determined by a shape and a material of the work, etc. In this manner, the two work vices 1*b*, 1*c* in the intermediate portions can be slid in longitudinal directions of the work vices on the table 87 when a large external force is applied to each of these work vices in these longitudinal directions.

In this state, the work 54 is weakly supported by the four work vices 1*a* to 1*d* therebetween. Next, the work 54 is strongly supported by work vices 1*a*, 1*d* therebetween at both end portions of the work 54. When positions of the work vices 1*b*, 1*c* in the intermediate portions are shifted from suitable positions for gripping the work 54, force for deforming the work 54 is applied to the work and the work vices 1*b*, 1*c* in the intermediate portions are slid to suitable positions for gripping the work 54 on the table 87 by reaction force applied from the work 54. Further, when the work 54 is strongly gripped by the work vices 1*b*, 1*c* therebetween in the intermediate portions, the fundamental base 3 of the work vices 1*b*, 1*c* located below the fixing claw 15 and the fixed claw 12 is deformed in an upward convex shape approximately having a high central portion by reaction force provided by gripping the work 54. The fixing flange 2 of the fundamental base 3 of each of the work vices 1*b*, 1*c* is pressed by this deformation against the pressing face 143 of the pressing flange 144 of each of the fixing jigs 4 so that force for pressing the fixing flange 2 by the pressing face 143 is increased. Accordingly, the two work vices 1*b*, 1*c* in the intermediate portions are strongly fixed to the table 87.

The pressing force of each of the fixing jigs for fixing the work vices in the intermediate portions is maintained at a set value unless each screw 151 is not touched. Accordingly, if the fixing jigs 4 each setting the pressing force to a suitable value by the screw 151 are prepared at every work, the work can be fixed to-the table without distorting the work so that high accurate processing can be simply realized.

Figure 22:
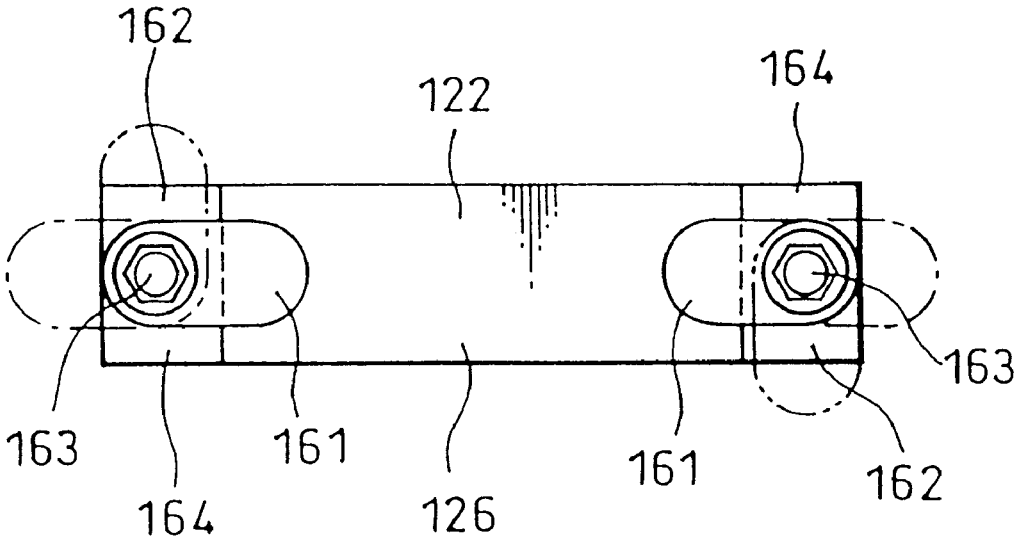
FIG. 22 is a bottom view of an example of the moving-free engaging towards the guide-groove of the fundamental-base, set at the tip of the foot of the intermediate-claw holder and the work-supporting base.

The intermediate-claw holder 122 shown in FIG. 22 and FIG. 12 can be equipped only after detaching the 1st movable-base 18 and the 2nd movable-base 19 from the slide-guide 5.

FIG. 22 shows a special structure of the fundamental-base 3 attached with the intermediate-claw holder 122, without detaching the 1st and 2nd movable-bases 18 and 19.

In this structure, the engaging-means 161 fitted in the guide-groove 6 of the fundamental-base is equipped at the top of the feet 162 on both sides of the T-groove 126 of the intermediate-claw holder 122, freely rotatable by the bolt 163.

The engaging-means 161 is rotated outwards and the intermediate-claw holder 122 is fitted over the slide-guide 5.

Then, the engaging-means 161 is rotated inwards to be fixed at the upper wall of the guide-groove 6 by the bolt 163.

Then, the intermediate-claw holder 122 can be fixed firmly.

The engaging-means 161 shown in FIG. 22 is of a rectangle with both ends being shaped semi-circular arcs. The bolt 163 is penetrated through the hole set in the center of the semi-circle at one side.

A stopper 164 is thrusted out to push the side of the engaging-means 161 to keep it rotationless.

When the engaging-means 161 rotates to the right (see from the bottom), the stopper 164 come across the engaging-means 161 which is coming inside. When the engaging-means 161 rotates to the left (see from the bottom), the stopper 164 come across the engaging-means 161 coming outside.

Figure 23:
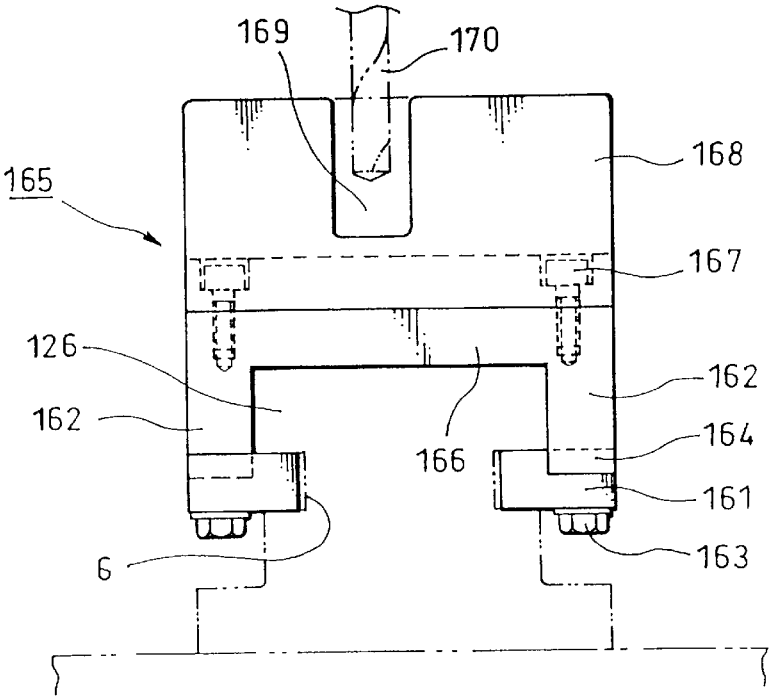
FIG. 23 is a front view of an example of the work-supporting base, set at the intermediate position of the fundamental-base, to support the back of the workpiece.
Figure 24:
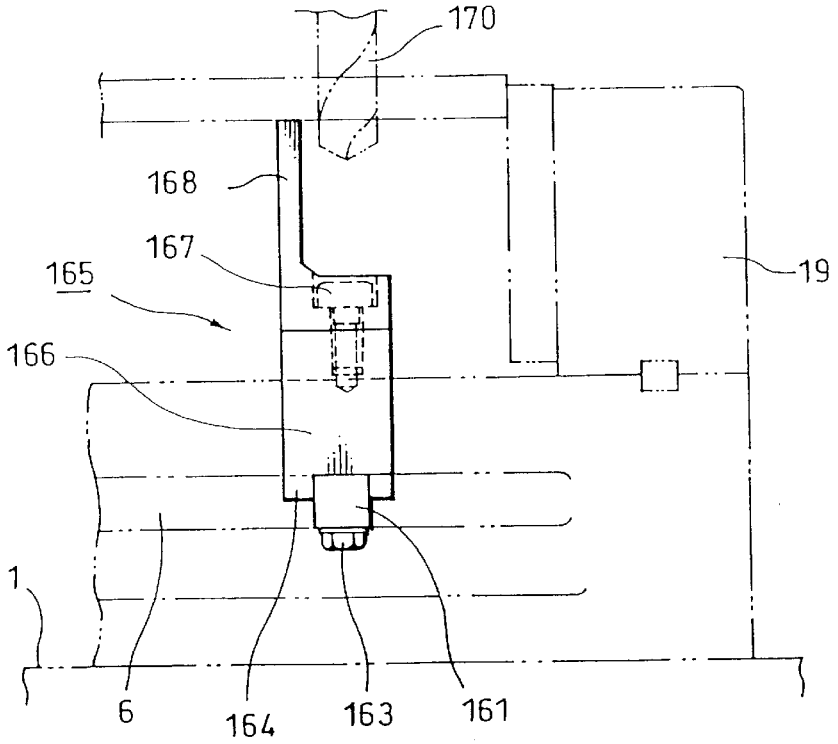
FIG. 24 a side view of the work-supporting base, shown in FIG. 23.

The above-stated structure, to fix the intermediate-claw holder 122, is quite recommendable to be set on the workpiece-supporting base (FIG. 23 and 24). When a thin workpiece shall be machined, the workpiece-supporting base is employed at the fundamental-base 3 to support the back of the thin workpiece 54.

The workpiece-supporting base 165 shown in FIG. 23 and FIG. 24 is equipped with the gate type base-block 166 to form T-groove 126 and the engaging means 161 fitted at the top of both feet of the base-block by the bolt 163, freely rotatable around the bolt, the supporting-block 168 being firmly set by the hexagonal-hole bolt 167 on the upper face of the base-block 166.

The engaging-means 161 and the stopper 164 are shown in FIG. 22. The supporting-block 168 is basically of a plate-shape, but in the special case the shape of the top can be of different style to clamp the different workpieces, as follows:

For example, as shown in FIG. 23, the upper part of the supporting-block 168 is made of a thin plate to support the workpiece with a narrow face.

And in addition, as shown in FIG. 23, the central part of the supporting-block 168 has the notch 169 to support the workpiece with the both ends of the block.

For example, to machine plural penetrating-holes to the workpieces in a fine pitch by the special design (as above) of the ends of the supporting-block 168, the tip of the drill 170 can avoid collision against the supporting-block 168. Prepare a supporting-block 168 of the maximum height, and the upper face of the block 168 shall be shaven off in accordance with the thickness of the workpiece.

The positioning-jig, which is to regulate the position of the side of the workpiece clamped by the work-vise, can be set at the 2nd movable base 19 supporting the movable-claw, and at the block-body 9 supporting the fixed-claw, and at the intermediate-claw holder 122.

Figure 25:
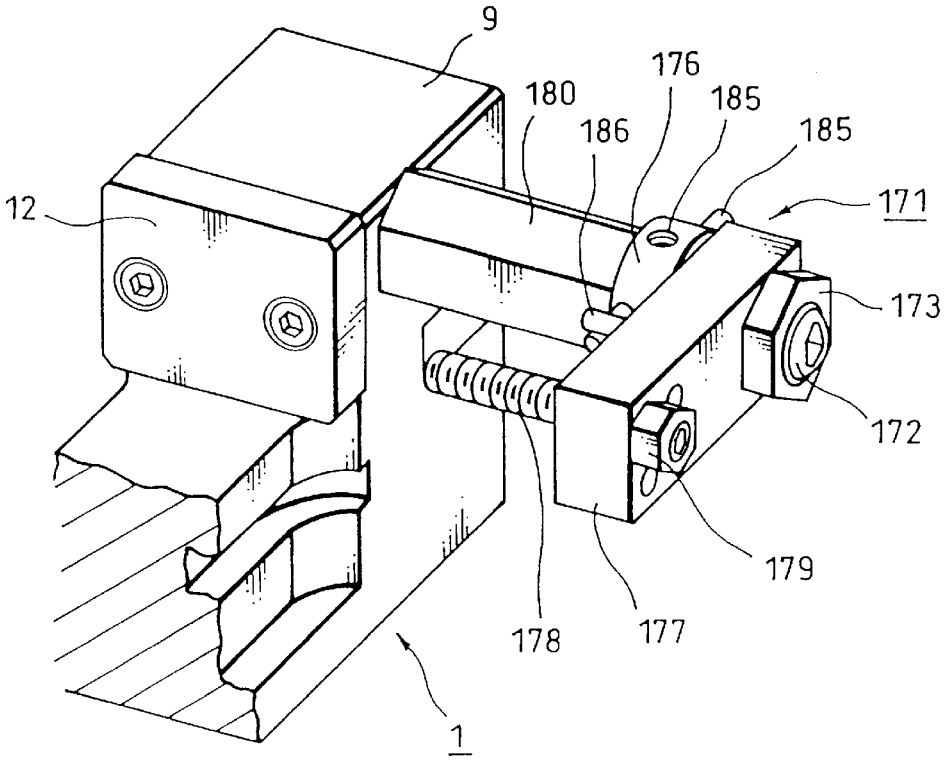
FIG. 25 is a perspective view of an example of the positioning-jig, set at the work-vise (Block Body), to regularly position the materials freely to the side of the workpiece.
Figure 26:
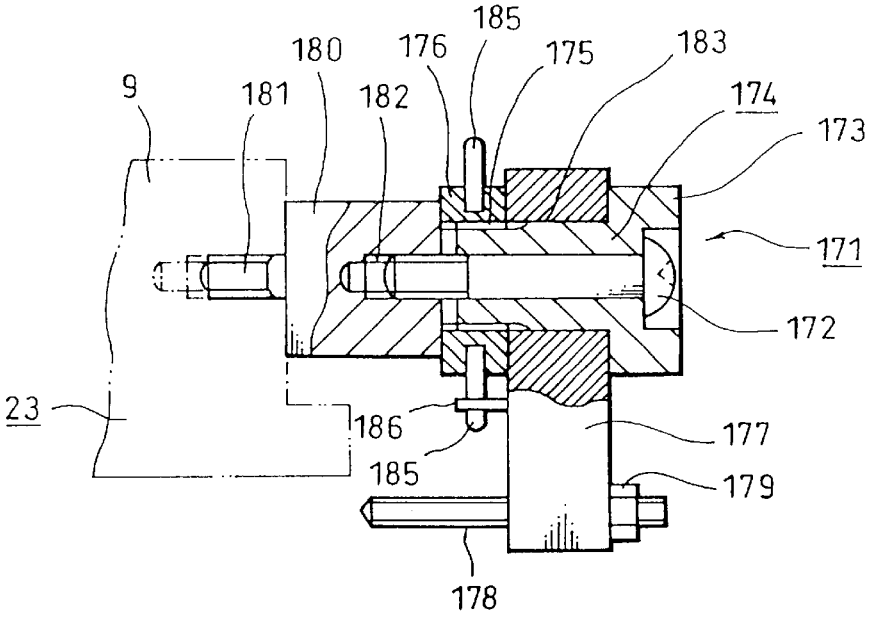
FIG. 26 is a cross-sectional view of the structure shown in FIG. 25.

FIG. 25 and FIG. 26 show examples of the positioning-jigs referred as above-stated. The positioning-jigs are set at the side of the block-body 9.

The positioning-jig 171 is composed of the sleeve 174 with a setting-bolt 172 and a flange 173, the nut 176 screwed up with the screwed part of the sleeve 175, the arm-block 177 which is set at the sleeve 174 rotatable in a softly-clamped condition by the flange 173 and the nut 176, the stud 178 screwed up with the tip of the arm-block 177, and the fixing-nut 179 for this stud 178.

The sleeve 174 has a hole, and the tip of the setting-bolt 171 is penetrated through the hole of the sleeve 174 to be screwed up with the tapped hole 182 of the spacer 180.

The sleeve 174 is composed of the screw part 175 and the cylinder part 183 supporting the flange 173 and the arm-block 177, and the nut 176 is screwed up with the screwed part 175.

The nut 176 is attached with the stop-screw 184, radius-wise, and the stopper-pins 185 are set radically at two points.

The arm-block 177 is fitted rotatably into the cylinder part 183 of the sleeve 174, and the stopper-receiver 186 is set at the back of the arm-block 177 to keep in touch with the stopper-pins 185.

At the tip of the arm-block 177, a screwed-hole is set parallel with axis of the sleeve 174. The stud 178 with a hexagonal-hole is screwed up into this screwed hole, and the screwing-up position can be regularly fixed by the fixing-nut 179.

The arm-block 177, after being inserted through the cylinder 183 of the sleeve 174, is lightly clamped by the flange 173 of the sleeve 174 and the nut 176 screwed up with the screw-part 175 of the sleeve. The nut 176 shall be screwed moderately to keep the arm-block 177 from trembling and to be turned easily.

The screwed-up position is fixed by the stopper-screw 184.

The positioning-jig 171 is generally fixed at the block-body 9 and the 2nd movable-base 19 of the work-vise employing with the spacer 180. The spacer 160 has, for an example, the screw-bolt 181 same as the setting-bolt 172 at one end, and the tapped-hole 182 to be screwed with the setting-bolt 172 at the other end. In this example, a tapped-hole is set at the side of the block-body 9 to receive the setting-bolt, and the spacer 180 can be fixed by screwing the screw-bolt 181 into the tapped-hole. Then the tip of the setting-bolt 172, penetrating into the sleeve 174, is screwed into the tapped-hole 182 of the spacer 180, and fasten the sleeve 174 rotationless.

At this time of fastening, the position of the stopper-pin 185 is set in order to support the arm-block 177 at the position of the arm-block 177 falling down towards the workpiece and the opposite position.

And after adjusting the positioning-lever 178 at the top of the arm-block 177 to set the basic position of the side of the workpiece 5, the positioning-lever is fixed by the fixing-nut 179.

To regulate the position of the side of the workpiece 54 to be clamped by the work-vise 1, the arm-block 177 is fallen down towards the workpiece to contact the side of the workpiece at the tip of the positioning-lever 178. Thus, the workpiece shall be regularly clamped.

To machine the side of the workpiece where the positioning-lever 178 is contacted, the arm-block 177 should be rotated to the side opposite to the workpiece.

By setting the spacer 180 as above-stated structure and setting the length of the screw-shaft 181 as same as the length of the setting-bolt 172, the positioning-jig 171 can be attached in plural steps.

That is, the 1st-step sleeve is fixed by the screwed-shaft of the 2nd-step spacer, and the 2nd-step sleeve is fixed by the setting-bolt of the 2nd-step spacer.

Thus, the position of the side of the workpiece can be regulated at the plural positions by rotating any arm-block of any positioning-jig set in plural steps selectively towards the workpiece.

Figure 27:
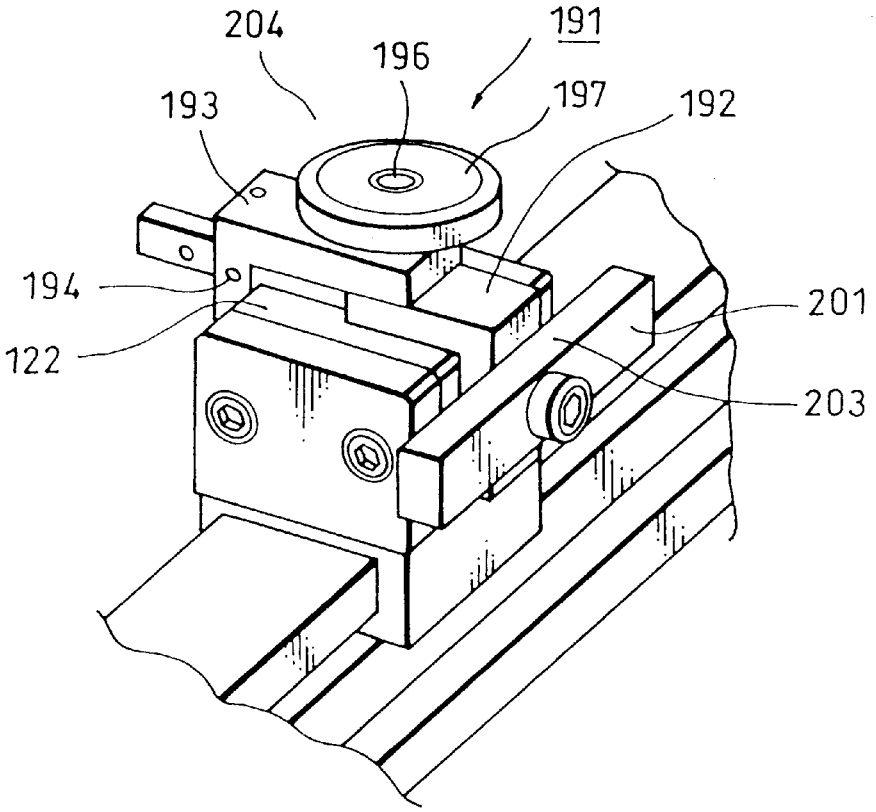
FIG. 27 is a perspective view of an example of the positioning-jig, set at the intermediate-claw holder, equipped with the loading-unloading mechanism to the work-vise.
Figure 30:
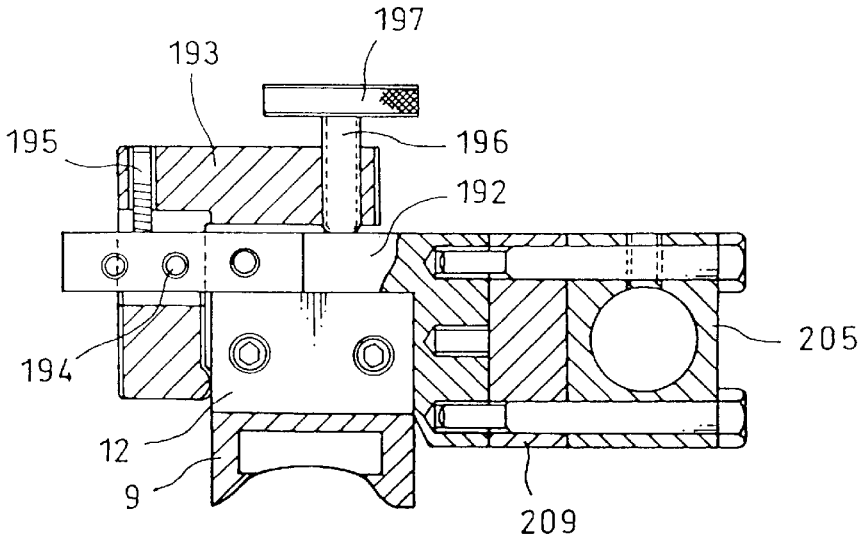
FIG. 30 is a cross-sectional view of the loading-unloading mechanism of the positioning-jig, as shown in FIG. 29.

FIG. 27 and FIG. 30 show other examples of the positioning-jig, being employed at the work-vise, to regulate the position of the side of the workpiece.

The positioning-jigs shown in FIG. 27 and FIG. 30 have the loading-unloading mechanism to it simply loading-unloading of the workpiece to the work-vise.

The loading-unloading mechanism 191 shown minutely in FIG. 30 has the L-type main bracket 192 and the L-type pushing bracket 193. The tip part of the main-bracket 192 and the L-type bend part of the pushing-bracket 193 are connected by the pin 194 to compose a gate type figure.

The spring 195 to open this gate type and the screw 196 with the pickup 197 to close this gate type are attached between the main-bracket 192 and the pushing-bracket 193. The main-bracket 192 has the tapped-hole in order to attach the positioning materials at the side.

Figure 28:
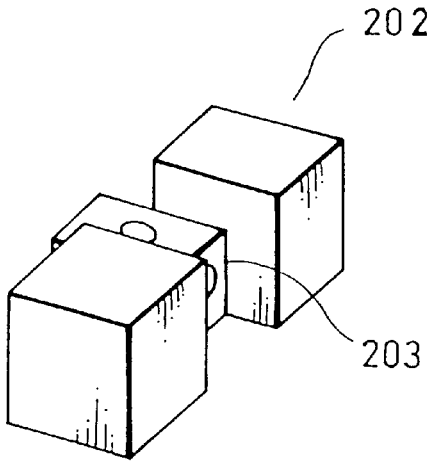
FIG. 28 is a perspective view of another example of the positioning-material fixed at the loading-unloading mechanism of the positioning-jig, as shown in FIG. 27.

To this tapped-hole, the positioning plate 201 (FIG. 27) and the positioning-block 202 (FIG. 28) can be attached with the spacer in necessity to regulate position of the side of the workpiece.

The positioning-plate 201 has the setting-portions 203 in the center. When being attached to the main bracket 192, position of the sides of the workpieces set at both sides of the workpieces set at both sides of the intermediate-claw holder 122 can be regulated.

On both sides of the attaching part 203, the positioning-blocks 202 (FIG. 28) is attached with cubes, each of which four sides have the different intervals from the attaching-parts.

The sides of the workpiece can be regulated in four different positions by changing the setting direction of the cubes to the main bracket 192.

The main-body bracket 192, which is equipped with the positioning-plate 201 and the positioning-block 202, is inserted to the block-body 9 which supports the intermediate-claw holder 122 and the fixed-claw of the work-vise with loosening the screw-mechanism 196. Then, turning the knob 197 of the screwing mechanism 196 to shut the gate type as above said, the main-body-bracket 192 can be fixed at the work-vise. When machining the workpiece, the positioning-jig should be detached by turning the knob 197 to loosen the screw-mechanism 196 to open the above-said gate type by means of the force of the spring 195.

Figure 29:
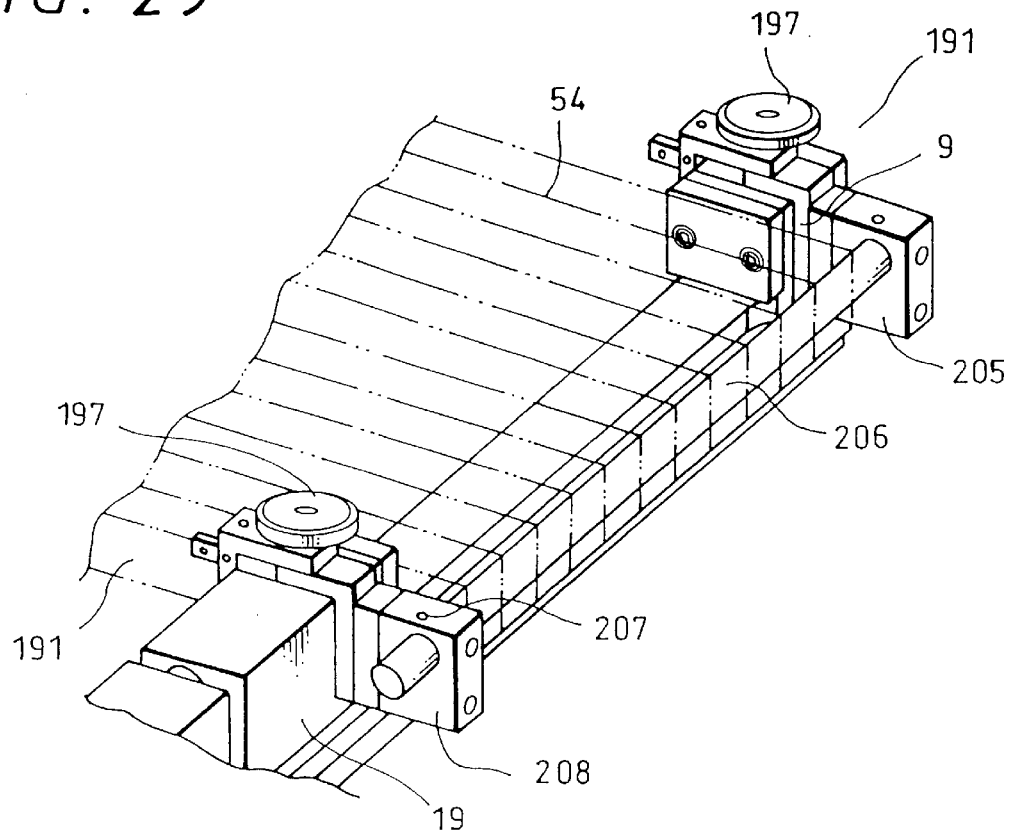
FIG. 29 is a perspective view of an example of the positioning-jig regularly position the flanks of plural workpieces clamped by the work-vises.

The positioning-jig 204 shown in FIG. 29 employs two sets of the loading-unloading mechanism 191 as above-state.

One end of the circular-bar 206 is fixed at the receiver-base 205 being fixed at one side.

At another receiver-base 208 being fixed at another side, the circular-bar 206 is inserted oscillation-free, and the setting-screw 207 to fix the circular-bar 206 at the receiver-base 208 of the oscillation-free side.

This positioning-jig 204 attaches one loading-unloading mechanism. to the block-body 9 supporting the fixed-claw of the work-vise, and another loading-unloading mechanism. to the 2nd movable-base 19 supporting the movable-claw.

In this condition, the circular-bar 206 is made parallel to the forwarding-retiring direction of the 2nd movable-base 19, which can go forwards and retire with the positioning-jig 204 attached.

Then, as shown in FIG. 29, put plural workpieces on the base of the work-vise, in the conditions that the 2nd-movable-base 19 is kept opened and the ends of plural workpiece are touched with the circular-bar, can be clamped altogether by going-forwards the 2nd movable-base 19.

Then, loosen the screw-mechanism 196 at the both sides to release the positioning-jig 204.

To release the positioning-jig 204, the circular-bar 206 is fixed by fastening the set-screw 207 attached on the receiving-base 208 with the circular-bar 206 being inserted through, easily oscillated. Thus, the operation of loading-unloading the jigs can be done more effectively.

The receiving-bases 205 and 206, as shown in FIG. 30, can be fixed at the loading mechanism 191 by setting the spacer 209 between, the basic position of the workpiece can be easily shifted by change of the spacer.

Therefore, you should prepare only various type spacers specially fit to various workpieces of different shapes and sizes, other materials can be used to any different workpieces. This is very economical.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. A vice for mounting on an elongated base comprising a slide guide mounted on said base in parallel longitudinal directions:

a first moving base having an upper portion and a lower leg portion, said lower leg portion slidably attached to said slide guide;

a second moving base capable of moving in an advancing direction of said first moving bases, being separated from said first moving base and sent out toward an advancing direction of said first moving base by a feed screw means attached to said first moving base for advancing and retracting said second moving base relative to said first moving base;

a plurality of cooperating positioning means arranged at a predetermined pitch in said elongated base and the lower surface of said second moving base to selectively position said first moving base;

a movable claw arranged on an advancing direction side of said second moving base and gripping one end of a work; and an arched roof portion integrally formed with an upper portion of said second moving base and extending over the upper portion of said first moving base, a lower face of said roof portion slidably coming in contact with said first moving base forming a sliding face parallel to said slide guide said roof portion protecting said first and second movable bases from entry of foreign material.

2. A work vise of a work s claimed in claim 1, wherein said roof portion covers said upper portion of said first moving base such that the roof portion is longer than an interval of said positioning means, and said arched roof portion has legs with an in per surface, said inner surface being in sliding contact with an outside surface of said upper portion of said first movable base forming a guide face.

3. A work vice of a work as claimed in claim 1 or 2, wherein worm screw means in said first moving base advances said feed screw relative to said first moving base.

4. A movable claw of a work vice comprising:

a base block having a multistage sawtooth shape on its front face which is constructed by a pushing-down face inclined slantingly downward with respect to reaction force from a work and a receiving face crossing said pushing-down face;

a claw block having a multistage sawtooth shape on its rear face which is constructed by a downward moving face coming in slide contact with said pushing-down face and a contact face opposed to said receiving face; and a rubber sheet interposed between said receiving face and said contact face, wherein said the base block and said claw block are fastened to each other through a resilient member.

5. A movable claw as claimed in claim 4, wherein said pushing-down face of said base block and said downward moving face of said claw block are set to multistage cylindrical faces rotatably adjustable in a horizontal direction with one central axis.

6. A work vice as claimed in claim 1, wherein said movable claw comprises:

a base block having a multistage sawtooth shape on its front face which is constructed by a pushing-down face included slantingly downward with respect to reaction fore from a work and a receiving face crossing said pushing-down face;

a claw block having a multistage sawtooth shape on its rear face which is constructed by a downward moving face coming in side contact with said pushing-down face and a contact face opposed to said receiving face; and a rubber sheet interposed between said receiving face and said contact face, wherein said base block and said claw block are fastened to each other through a resilient member.

7. A work vice as claimed in claim 6, wherein said pushing-down face of said base block and said downward moving face of said claw block are set to multistage cylindrical faces rotatably adjustable in a horizontal direction with one central axis.

8. A work vice as claimed in claim 7, further comprising means for securing an adjustable vertical position of said base block relative to said claw block.

9. A work vice as claimed in claim 1, wherein said lower leg portion of said first moving base has a width larger than a width of said upper portion of said first movable base forming a shoulder portion forming said sliding face.

* * * * *